US008534352B2

(12) United States Patent
Dai

(10) Patent No.: US 8,534,352 B2
(45) Date of Patent: Sep. 17, 2013

(54) METHODS AND APPARATUS FOR ENHANCED OIL RECOVERY

(75) Inventor: Liming Dai, Regina (CA)

(73) Assignee: University of Regina, Regina (CA)

( * ) Notice: Subject to any disclaimer, the term of this patent is extended or adjusted under 35 U.S.C. 154(b) by 700 days.

(21) Appl. No.: 12/522,506

(22) PCT Filed: Jan. 8, 2008

(86) PCT No.: PCT/CA2008/000023

§ 371 (c)(1),
(2), (4) Date: Aug. 18, 2010

(87) PCT Pub. No.: WO2008/083471

PCT Pub. Date: Jul. 17, 2008

(65) Prior Publication Data

US 2010/0300681 A1 Dec. 2, 2010

Related U.S. Application Data

(60) Provisional application No. 60/883,892, filed on Jan. 8, 2007.

(51) Int. Cl.
*E21B 43/25* (2006.01)
*E21B 28/00* (2006.01)

(52) U.S. Cl.
USPC ..... 166/249; 166/177.1; 166/177.6

(58) Field of Classification Search
USPC ..... 166/249, 177.1, 177.6
See application file for complete search history.

(56) References Cited

U.S. PATENT DOCUMENTS 2,806,533 A * 9/1957 Fleck ..... 166/249
4,316,521 A * 2/1982 Chelminski ..... 181/114
4,417,621 A * 11/1983 Medlin et al. ..... 166/249
4,605,089 A * 8/1986 Kravchenko et al. ..... 181/114
4,945,986 A * 8/1990 Hardin et al. ..... 166/249

(Continued)

FOREIGN PATENT DOCUMENTS

CA 2406794 A1 9/2001
CA 2398393 A1 6/2002
WO 02/46572 A1 6/2002

OTHER PUBLICATIONS

International Search Report of PCT/CA2008/000023 dated Apr. 24, 2008.

(Continued)

*Primary Examiner* — Jennifer H Gay
(74) *Attorney, Agent, or Firm* — Bereskin & Parr LLP S.E.N.C.R.L., s.r.l.

(57) ABSTRACT

Methods, apparatus and systems for controllably mobilizing, flowing and maneuvering the flow of hydrocarbon-containing materials within and about a subterranean reservoir. The system comprises selectively positioning at a ground surface level above a subterranean reservoir containing hydrocarbon-containing materials, at least three seismic apparatus spaced apart in a triangulated configuration. The system is provided with an electronic seismic control device configured to controllably communicate with and cooperate with each of the seismic apparatus to concurrently modulate the amplitudes and frequencies of the vibrational energies produced therefrom. The system is provided with a sensing apparatus configured to detect and monitor changes in the fluidity and movement of the hydrocarbon-containing materials about the subterranean reservoir. The electronic seismic control device is controllably manipulated to precisely modulate the frequencies and amplitudes of the seismic vibrational energies emitted by each of the seismic apparatus to controllably maneuver the flow of the fluidized hydrocarbon-containing materials about the subterranean reservoir.

7 Claims, 16 Drawing Sheets

(56) References Cited

U.S. PATENT DOCUMENTS

| | | | | |
|---|---|---|---|---|
| 5,101,899 | A | 4/1992 | Hoskins et al. | |
| 5,131,477 | A | 7/1992 | Stagg et al. | |
| 5,371,330 | A * | 12/1994 | Winbow | 181/106 |
| 5,396,955 | A * | 3/1995 | Howlett | 166/249 |
| 5,628,365 | A * | 5/1997 | Belonenko | 166/249 |
| 5,660,231 | A * | 8/1997 | Belonenko | 166/249 |
| 5,877,995 | A * | 3/1999 | Thompson et al. | 367/14 |
| 6,227,293 | B1 | 5/2001 | Huffman et al. | |
| 6,328,102 | B1 * | 12/2001 | Dean | 166/248 |
| 6,405,797 | B2 * | 6/2002 | Davidson et al. | 166/249 |
| 6,851,473 | B2 * | 2/2005 | Davidson | 166/263 |
| 6,899,175 | B2 * | 5/2005 | Kostrov et al. | 166/249 |
| 7,453,763 | B2 * | 11/2008 | Johnstad | 367/20 |
| 8,064,287 | B2 * | 11/2011 | Harris et al. | 367/38 |
| 2001/0017206 | A1 * | 8/2001 | Davidson et al. | 166/249 |
| 2002/0195246 | A1 * | 12/2002 | Davidson | 166/249 |
| 2003/0201101 | A1 | 10/2003 | Kostrov et al. | |
| 2005/0006146 | A1 | 1/2005 | Mody et al. | |
| 2005/0098314 | A1 * | 5/2005 | Pope et al. | 166/249 |
| 2005/0224279 | A1 | 10/2005 | Gilmer et al. | |
| 2006/0249286 | A1 | 11/2006 | Serdjukov et al. | |
| 2010/0300681 | A1 * | 12/2010 | Dai | 166/249 |
| 2011/0139441 | A1 * | 6/2011 | Zolezzi Garreton | 166/249 |

OTHER PUBLICATIONS

Written Opinion of the International Searching Authority dated Apr. 10, 2008.

Biot, M.A. (1956a) Theory of Propagation of Elastic Waves in Fluid-Saturated Porous Solid. I. Low-Frequency Range. Journal of the Acoustical Society of America(JASA). 28:168-178.

Biot, M.A. (1956b) Theory of Propagation of Elastic Waves in Fluid-Saturated Porous Solid. II. Higher Frequency Range. JASA. 28:179-191.

Vardoulakis, I. and Beskos, D. E. (1986) Dynamic behavior of nearly saturated porous media. Mech. Matls. 5:87-108.

White, J.E. (1975) Computed seismic speeds and attenuation in rocks with partial gas saturation. Geophysics 40:224-232.

Bardet, J.P. and Sayed, H. (1993) Velocity and attenuation of compressional waves in nearly saturated soils. Soil Dynamics and Earthquake Engineering 12:391-401.

Gurevich, B., Kelder, O., and Smeulders, D.M.J. (1999) Validation of the Slow Compressional Wave in Porous Media: Comparison of Experiments and Numerical Simulations. Transport in Porous Media 36:149-160.

Berryman, J.G. (1985) Scattering by a spherical inhomogeneity in a fluid-saturated porous medium. J. Math. Physics 26:1408-1419.

Tsiklauri, D. and Beresnev, I. (2003) Properties of Elastic Waves in a Non-Newtonian (Maxwell) Fluid-Saturated Porous Medium. Transport in Porous Media 53:39-50.

Hamidzadeh, H.R. and Luo, A.C.J, (2000) A semi-analytical solution for responses of the surface of an elastic half-space subjected to vertical, harmonic, concentrated forces, Vibration and Control of Continuous Systems 107:39-44.

Pham, N. H., Carcione, J. M., Helle, H. B., and Ursin, B., 2002, Wave velocities and attenuation of shaley sandstones as a function of pore pressure and partial saturation. Geophys. Prosp. 50:615-627.

Lin, C.H., Lee, V.W., and Trifunac, M.D., (2001) On the reflection of waves in a poroelastic half-space saturated with non-viscous fluid. Report No. CE 01-04, Los Angeles, California.

Plona, T.J. and Johnson, D.L. (1984) Acoustic properties of porous systems: I. Phenomenological description. IN Physics and Chemistry of Porous Media, edited by Johnson, D.L. and Sen, P.N. (Ed) American Institute of Physics, New York, pp. 89-104.

Pao, Y.H. and Mow, C.C. (1973) Diffraction of elastic waves and dynamic stress concentration. Crane-Russak Inc., New York.

Andrews, G.E., Askey, R., and Roy, R. (2001) Special Functions. Cambridge University Press, Cambridge.

Wang, G. and Liu, D. (2002) Scattering of SH-wave by multiple circular cavities in half space. J. Earthquake Eng. Eng. Vibr., 1(1):36-44.

Wang, G. Q., Dai, L., and Dong, M. Response of fluid-saturated elastic porous media to excitations of multiple energy sources, Proceedings of the Institution of Mechanical Engineers, Part K: Journal of Multi-Body Dynamics, 2007,221, 319-330.

Wang, G. Q., Dai, L., and Dong, M. Attenuated wave field in fluid-saturated porous medium with excitations of multiple sources, Transport in Porous Media, 2009, 79, 359-375.

* cited by examiner

*Prior art*

(a)

(a)

(b)

(a)

(b)

METHODS AND APPARATUS FOR ENHANCED OIL RECOVERY

CROSS-REFERENCE TO RELATED APPLICATIONS

This is a national stage application of International Application No. PCT/CA2008/000023 filed Jan. 8, 2008, which claims priority to U.S. Provisional Application 60/883,892 filed Jan. 8, 2007, and the entire contents of each are hereby incorporated herein by reference.

FIELD OF THE INVENTION

This invention relates to recovery of hydrocarbon-containing substances from subterranean reservoirs. More particularly, this invention relates to manipulation of vibrational energies directed toward subterranean reservoirs for affecting the viscosities and flows of hydrocarbon-containing substances therein.

BACKGROUND OF THE INVENTION

Significant challenges are associated with the recovery of hydrocarbon-containing substances such as crude oil from subterranean reservoirs. Subterranean reservoirs typically possess convoluted, fractured and crevassed bottom surface topographies wherein significant quantities of crude oil remain in pools that are inaccessible by conventional oil well extraction systems. Numerous strategies and technologies have been developed to increase the efficiency and extent of crude oil recovery from subterranean reservoirs. Such strategies include injecting water or steam or inert gas through well casings into the reservoirs to break up obstacles (i.e., bottom surface formations) impeding the flow of crude oil to the well, or alternatively, to reduce the viscosity of the oil to increase its flowability. Other strategies to increase the flowability of crude oil within subterranean reservoirs include applications of vibrational energies generated by: (a) seismic shock as a resulted of repeatedly dropping and raising a weight within a well casing, or (b) by lowering an ultrasonic wave generating device e.g., a transducer into a well casing and then manipulating the amplitude and frequency of the waves generated. However, significant volumes of crude oil remain inaccessible.

Dynamics of porous media is of intense research concerns in petroleum engineering, geophysics, geotechnical engineering, and civil engineering, and has been extensively studied for decades. Demands from soil mechanics, oil production, modern earthquake and offshore engineering have further motivated the research on the dynamics of fluid-saturated porous media. By introducing the assumptions that the solid skeleton of the porous medium obeys the laws of homogeneous linear elasticity and the fluid obeys Darcy's laws, Biot (1956a, J. Acoust. Soc. Am. 28:168-178; 1956b, J. Acoust. Soc. Am. 28: 179-191) formulated the governing equations for wave propagation in a fully saturated medium. Biot (1956a; 1956b) also proved the existence of two compressional waves, namely the first and second compressional waves, and one rotational wave in a porous medium fully saturated by fluid. The first compressional wave is also known as the fast wave that is very similar to the compressional wave in an elastic medium, for which the displacements of solid and fluid are in phase. The second compressional wave is usually named as slow wave that has a strongly dispersive characteristic, for which the displacements of fluid and solid are out of phase. Following Biot's theory, Vardoulakis and Beskos (1986, Mech. Comp. Mat. 5: 87-108) developed a theory describing wave propagation in a three-phase porous medium which is applicable to partially-saturated materials. White (1975, Geophysics, 40: 224-232) demonstrated that wave velocity and attenuation are substantially affected by the presence of partial saturation, depending mainly on the size of the gas pockets (saturation), frequency, permeability and porosity of the media. Bardet and Sayed (1993, Soil Dynamics and Earthquake Engineering, 12: 391-402) provided exact and approximate expressions for the velocity and attenuation of the compressional waves within nearly fully saturated poroelastic media.

Recently, numerous research works are performed to improve Blot's theory and to broaden the applications of Biot's theory. Gurevich et al. (1999, Transport in Porous Media, 36: 149-160) utilized experiment and simulation methods to verify Biot's theory. Investigation on the scattering of a fast compression wave by an inhomogeneity in a fluid-saturated medium was presented by Berryman (1985, J. Math. Physics, 26: 1408-1419), who proved that there would be three scattering waves, namely a fast compression wave, a slow compression wave, and a shear wave. The properties of elastic waves in a non-Newtonian (Maxwell) fluid-saturated porous medium were studied by Tsiklauri and Beresnev (2003, Transport in Porous Media, 53: 39-50). It is generally accepted that the wave will attenuate due to the presence of the pore fluid in the porous media. Wave velocities and attenuation are two key aspects of the waves in porous media, since they are important in analyzing the dynamic response of the media with respect to the properties of the media and the wave sources, such as viscosity, frequency and porosity. Hamidzadeh and Luo (2000, Vibration and Control of Continuous Systems 107: 39-44) investigated the dynamic response of the surface of an elastic soil medium which was excited by a vertical harmonic concentrated force by using a semi-analytical method. Based on Biot-type three-phase theory, Pham et al. (2002, Geophys. Pros. 50: 615-627) presented the wave velocities and quality factors of clay-bearing sandstones as a function of pore pressure, frequency and partial saturation. A dispersion coefficient was introduced to reflect the friction between the fluid and solid in a porous medium. Extensional wave attenuation and velocity measurements on high permeability Monterey sand were performed by the authors over a range of gas saturations for imbibition and degassing conditions. The result showed that partially-saturated sands under moderate confining pressure can produce strong intrinsic attenuation for extensional waves. It was found in the study that the velocities show a gradual decrease with increasing water saturation, followed by a sharp increase at near full saturation.

In the current literature, however, there are very few studies focusing on investigating the relative displacements between the fluid and solid in a porous medium fully-saturated by Newtonian fluid. Furthermore, the prior art in this field postulates a single energy source existing in the field being considered.

Governing Equation Development

The following nomenclature is used in the prior art section and invention disclosure sections herein:

$C_1$, $C_2$—refer to the amplitudes of the waves propagating in solid and fluid respectively;

$d_j$—refers to the distance from a source to the origin;

$e$—refers to the volume strains of solid;

exp(•)—refers to an exponential function;

H—refers to an introduced physical parameter;

$H_0^{(1)}(\bullet)$—refers to a zero-order Hankel function of the first kind;

$K_b$—refers to the bulk modulus of the skeletal frame;
$K_f$—refers to the bulk modulus of the fluid;
$K_s$—refers to the bulk modulus of the solid;
l—refers to a wave number;
p—refers to fluid pressure;
r—refers to the distance from a point in the field to a source;
r—refers to a radius coordinate in a polar system;
$r_j$—refers to the distance from a point P to the $j^{th}$ wave sources;
$s_{ij}$—refers to the stresses acting on the fluid of a porous medium;
t—refers to time;
u—refers to the displacement vector of a fluid;
$u_{0j}$, $U_{0j}$—refer to the displacements of the and fluid of the $j^{th}$ source respectively (j=1, 2, . . . , n);
$u_{0j}$, $U_{0j}$—refer to the displacement vectors of solid and fluid excited by the $j^{th}$ source respectively (j=1, 2, . . . , n);
U—refers to the displacement vector of a solid;
$V_1$—refers to the dilatation wave velocity with respect to a first compressible wave;
$V_2$—refers to the dilatation wave velocity with respect to a second compressible wave;
$V_c$—refers to the ratio of H and ρ;
V—refers to the reference wave velocity;
x, y—refers to the coordinates of a Cartesian coordinate system;
$z_j$—refers to an introduced complex variable;
α—refers to the coefficient related to porosity;
$\delta_{ij}$—is the Kronecker symbol;
ϵ—refers to the volume strains of a fluid
θ—refers to the angular coordinate in a polar system
$\mu_s$—refers to the shear modulus of a material;
$\nu_s$—refers to the Poisson ratio of a solid;
ξ—refers to the ratio between reference velocity and wave velocity;
$\xi_I$, $\xi_{II}$—refers to roots;
ρ—refers to a density parameter;
$\rho_{11}$, $\rho_{12}$, $\rho_{22}$—refers to the density terms of a porous medium;
$\rho_f$—refers to the mass density of a fluid;
$\rho_s$—refers to the mass density of a solid;
$\sigma_{ij}$—refers to the total stresses of a porous medium;
$\sigma_{ij}^s$—refers to the stresses acting on the solid frame of a porous medium;
ϕ—refers to the porosity of a medium;
$\phi_s$,—refers to the scalar potential of a solid;
$\phi_f$—refers to the scalar potential of a fluid;
$\psi_f$—refers to the vector potential of a solid;
$\psi_s$—refers to the vector potential of a fluid;
ω—refers to the frequency of a wave; and
∇, $\nabla^2$—refers to Laplacians.

Biot's theory provides a framework for analyzing the wave propagation in porous media. In Biot's most representative papers in this field (Biot, 1956a, b), the fluid in porous medium is assumed to be compressible and may flow relative to the solid. To derive the wave equations in low frequency range, the following assumptions are made:

(1) the relative motion of the fluid in pores is a laminar flow which follows Darcy's law;
(2) the elastic wavelength of the wave traveling in the porous media is much larger than that of the unit solid-fluid element;
(3) the size of the unit element is geometrically large in comparison with that of the pores.

Some other basic assumptions in elastic mechanics are also employed, such as homogeneity and isotropy of the porous media material and the impervious of the pore wall, as stated in Biot's studies (Biot, 1956a).

Generally, the stresses acting on a porous medium can be separated into two parts: one is on the solid frame which can be written as $\sigma_{ij}^s$; the other is on the fluid represented by $s_{ij}=-\phi p\delta_{ij}$. Thus the total stresses are expressed by: $\sigma_{ij}=\sigma_{ij}^s+s_{ij}$. Where ϕ is the porosity of the medium; p is the fluid pressure; $\delta_{ij}$ is Kronecker symbol; the negative sign existing in the equation is for the association of directions between fluid pressure and stress. Starting with the above stress expressions of a porous medium and by employing the force equilibrium relation, the dynamics equations of a porous medium can be written as:

$$\begin{cases} N\nabla^2 u + \nabla[(A+N)e + Q\varepsilon] = \dfrac{\partial^2}{\partial t^2}(\rho_{11}u + \rho_{12}U) + b\dfrac{\partial}{\partial t}(u-U) \\ \nabla[Qe + R\varepsilon] = \dfrac{\partial^2}{\partial t^2}(\rho_{12}u + \rho_{22}U) - b\dfrac{\partial}{\partial t}(u-U) \end{cases} \quad (1a, b)$$

The coefficient b is related to Darcy's coefficient of permeability k by $$b = \frac{\mu\phi^2}{k} \quad (2)$$

where, μ is the fluid viscosity and ϕ is the porosity of the medium.

In Eq. (1), u and U are the displacement vectors of fluid and solid respectively, which consist of the quantities and directions of the displacements. While e and ϵ are the volume strains of the solid and fluid respectively with the expressions: $e=\nabla\cdot u$, $\epsilon=\nabla\cdot U\cdot\rho_{11}$, $\rho_{12}$ and $\rho_{22}$ are density terms, which can be expressed as: $\rho_{11}=(1-\phi)\rho_s$, $\rho_{22}=\phi\rho_f$, $\rho_{12}=-(\alpha-1)\phi\rho_f$, while $\rho_s$ is the mass density of the solid grains, $\rho_f$ is the mass density of the fluid in pores, $\alpha=(1/2)[\phi^{-1}+1]$, ϕ is the porosity of the medium. A, N, Q and R are the physical parameters of the medium. A and N are similar as Lame coefficients in elastic theory. N represents the shear modulus of the medium; R is a measure of pressure on the fluid required to drive a unit volume of fluid into the porous medium. Q describes the coupling between the volume change of solid and that of fluid. The expressions for A, N, Q and R will be given in following section.

Based on Eq. (1), Biot (1956a; 1956b) presented the expressions for three waves existing in a porous medium in the form of the volume strain. However, it is not convenient to quantify the displacements from volume strains, especially when a two- or three-dimensional domain is considered. Accordingly, the detailed description for deriving the waves expressions in the form of displacement will be present.

Applying Helmholtz decomposition to the displacement vectors of solid and fluid, respectively:

$$\begin{cases} u = grad(\varphi_s) + \mathrm{curl}(\psi_s) \\ U = grad(\varphi_f) + \mathrm{curl}(\psi_f) \end{cases} \quad (3a, b)$$

where $\phi_s$ and $\phi_f$ are scalar potentials of solid and fluid respectively, $\psi_s$ and $\psi_f$ are vector potentials for the displacements of solid and fluid. $\psi_s$ and $\psi_f$ also satisfy the conditions: $\nabla\cdot\psi_s=0$ and $\nabla\cdot\psi_f=0$.

For P-wave, also named compressional wave, the displacement is corresponding to the scalar potentials, without rotation, that implies $\nabla\times u=0$. For S-wave, also known as rotational wave or shear wave, the displacement is due to vector potentials, $\nabla\cdot u=0$. Substituting Eq. (3) into Eq. (1), and rearranging the terms according to the scalar and vector potentials, as Lin et al. (2001, Report No. CE 01-04, Los Angeles, Calif., USA) did in their research, two sets of equations can be obtained corresponding to scalar potentials and vector potentials of the fluid and solid. Thus, the expressions for P- and S-waves can be given as:

For P-wave:

$$\begin{cases} \nabla^2(P\varphi_s + Q\varphi_f) = \dfrac{\partial^2}{\partial t^2}(\rho_{11}\varphi_s + \rho_{12}\varphi_f) + b\dfrac{\partial}{\partial t}(\varphi_s - \varphi_f) \\ \nabla^2[Q\varphi_s + R\varphi_f] = \dfrac{\partial^2}{\partial t^2}(\rho_{12}\varphi_s + \rho_{22}\varphi_f) - b\dfrac{\partial}{\partial t}(\varphi_s - \varphi_f) \end{cases} \quad (4a, b)$$

For S-wave:

$$\begin{cases} N\nabla^2\psi_s = \dfrac{\partial^2}{\partial t^2}(\rho_{11}\psi_s + \rho_{12}\psi_f) + b\dfrac{\partial}{\partial t}(\psi_s - \psi_f) \\ 0 = \dfrac{\partial^2}{\partial t^2}(\rho_{12}\psi_s + \rho_{22}\psi_f) - b\dfrac{\partial}{\partial t}(\psi_s - \psi_f) \end{cases} \quad (5a, b)$$

in which, P=A+2N is an introduced variable. Eqs. (4) and (5) are the governing equations of the waves propagating in porous media in terms of displacement potentials. These make it available to study the compression waves and shear wave separately or jointly in analyzing waves propagating in porous medium.

As in the case of purely elastic waves, the body waves can be separated into uncoupled rotational and dilatational waves. For P-wave, to get the governing equations expressed in the form of displacements, applying the divergence operation to Eq. (4), the equations for dilatational waves can be obtained in the following form:

$$\begin{cases} \nabla[\nabla^2(P\varphi_s + Q\varphi_f)] = \\ \nabla\left[\dfrac{\partial^2}{\partial t^2}(\rho_{11}\varphi_s + \rho_{12}\varphi_f)\right] + \nabla\left[b\dfrac{\partial}{\partial t}(\varphi_s - \varphi_f)\right] \\ \nabla[\nabla^2(Q\varphi_s + R\varphi_f)] = \\ \nabla\left[\dfrac{\partial^2}{\partial t^2}(\rho_{12}\varphi_s + \rho_{22}\varphi_f)\right] - \nabla\left[b\dfrac{\partial}{\partial t}(\varphi_s - \varphi_f)\right] \end{cases} \quad (6a, b)$$

Let $\phi$ be a general displacement scalar potential and u a general displacement vector. For P-wave, the displacement vector u is just related to the scalar potential $\phi$ by:

$$u=\nabla\phi \quad (7)$$

The scalar potential $\phi$ also has the following property:

$$\nabla(\nabla^2\phi)=\nabla[\nabla\cdot(\nabla\phi)]=\nabla\times[\nabla\times(\nabla\phi)]+\nabla^2(\nabla\phi)=\nabla^2(\nabla\phi) \quad (8)$$

Therefore, with equations of Eqs. (7) and (8), the governing equations of Eq. (4) for the dilatation waves can be written in the form of displacements as:

$$\begin{cases} \nabla^2(Pu_{sp} + QU_{fp}) = \dfrac{\partial^2}{\partial t^2}(\rho_{11}u_{sp} + \rho_{12}U_{fp}) + \\ b\dfrac{\partial}{\partial t}(u_{sp} - U_{fp}) \\ \nabla^2[Qu_{sp} + RU_{fp}] = \dfrac{\partial^2}{\partial t^2}(\rho_{12}u_{sp} + \rho_{22}U_{fp}) - \\ b\dfrac{\partial}{\partial t}(u_{sp} - U_{fp}) \end{cases} \quad (9a, b)$$

in which, the subscript 's' represents the displacement of solid, 'f' represents the displacement of the fluid, 'p' represents the displacement due to the P-wave. In Eq. (9), the parameters of material, P, Q, R can be expressed as (Plona et al., 1984, *IN* Physics and Chemistry of Porous Media, Johnson and Sen, Eds. American Institute of Physics, New York, pp. 89-104; Biot et al., 1957, J. Appl. Mech. 24: 594-601; Lin et al., 2001, Report No. CE 01-04, Los Angeles, Calif., USA):

$$P = \frac{(1-\phi)\left[1-\phi-\dfrac{K_b}{K_s}\right]K_s + \phi\dfrac{K_s}{K_f}K_b}{1-\phi-\dfrac{K_b}{K_s}+\phi\dfrac{K_s}{K_f}} + \frac{4}{3}N \quad (10)$$

$$Q = \frac{\left[1-\phi-\dfrac{K_b}{K_s}\right]\phi K_s}{1-\phi-\dfrac{K_b}{K_s}+\phi\dfrac{K_s}{K_f}} \quad (11)$$

$$R = \frac{\phi^2 K_s}{1-\phi-\dfrac{K_b}{K_s}+\phi\dfrac{K_s}{K_f}} \quad (12)$$

in which, $\phi$ is the porosity of the porous medium; $K_f$, $K_s$, $K_b$, N are property parameters of the material. $K_f$ is the bulk modulus of the fluid; $K_s$ is the bulk modulus of the solid; $K_b$ is bulk modulus of the skeletal frame; N is the shear modulus of the skeletal frame. Eq. (9) are the governing equations for P-wave propagating in the porous medium. It should be noted that the wave equations are all written in terms of displacements of solid and fluid. The governing equations in terms of displacement for S wave also can be obtained by applying the curl operator to Eq. (5).

SUMMARY OF THE INVENTION

The exemplary embodiments of the present invention, at least in preferred forms, are directed to methods, apparatus and systems for manipulating the mobility and fluidity of hydrocarbon-containing substances, and maneuvering the flows of mobilized hydrocarbon-containing substances within and about subterranean reservoirs.

According to a preferred embodiment of the present invention, there is provided a method for increasing the mobility and fluidity of a hydrocarbon-containing substance thereby increasing its flowability in a subterranean reservoir by providing a plurality of spaced-apart electronically cooperating three-dimensional sources of controllably manipulable vibrational energy directed at the subterranean reservoir to affect the mobility and flows of hydrocarbon-containing substances therein. The plurality of three-dimensional energy sources may be spaced apart as follows: (a) a plurality of three-dimensional sources of controllably manipulable vibrational energy situated on the ground surface above a subterranean reservoir; (b) a plurality of three-dimensional sources of controllably manipulable vibrational energy spaced apart underneath the earth's surface e.g., in two or more spaced-apart well bores drilled into and/or about a subterranean reservoir; and (c) a plurality of spaced-apart three-dimensional sources of controllably manipulable vibrational energy comprising at least one source situated above ground and at least one source situated below the earth's surface. It is preferred that at least three spaced-apart electronically cooperating ground surface sources of controllably manipulable vibrational energy are provided. It is suitable to provide more than three spaced-apart electronically cooperating sources of controllably manipulable vibrational energy for certain applications of the present invention disclosed herein.

According to one aspect, the plurality of ground surface sources of controllably manipulable vibrational energy directed at the subterranean reservoir are positionally triangulated above and about the subterranean reservoir. Suitable vibrational energy includes seismic waves and ultrasonic waves. Each of the sources of controllably manipulable vibrational energy is provided with an apparatus configured for precisely maneuvering and targeting the direction of the vibrational energy emitted toward a selected point in the subterranean reservoir. An exemplary source of controllably manipulable vibrational energy is a seismic apparatus. Each seismic apparatus is provided with electronic means for precisely modulating the frequency and amplitude of the vibrational energy emitted therefrom. The seismic apparatus are configured to communicate with and cooperate with an electronic seismic control device.

According to another aspect, there is provided a seismic apparatus configured for controllably and directionally emitting vibrational energies precisely directed toward a target portion of a hydrocarbon-containing substance within a subterranean reservoir, said vibrational energies comprising pluralities of seismic waves having electronically manipulable frequencies and amplitudes. Alternatively, the vibrational energies may comprise ultrasonic waves. Optionally, the vibrational energies may comprise pluralities of seismic waves and ultrasonic waves.

According to yet another aspect, the seismic apparatus is configured to generate vibrational energies comprising waves having electronically manipulable frequencies and amplitudes. The seismic apparatus comprises a wave-generating device having an emitting portion which can be controllably manipulated in a rotatable and/or pivotable manner to provide precise focusing and aiming at target zones within a subterranean structure, e.g., a reservoir.

According to a further aspect, the seismic devices are mountable on a transportable platform. The transportable platform may be configured to be mountable on a flat-bed trailer configured to cooperate with hauling equipment. Alternatively, the transportable platform may be a flat-bed trailer configured to cooperate with hauling equipment. Exemplary hauling equipment includes heavy-duty over-road truck tractors, farm tractors, track-mounted bulldozers, off-road earth moving equipment and the like.

According to another preferred embodiment of the present invention, there is provided software configured for cooperating with an electronic seismic control device configured for affecting the mobility, fluidity, and flow of hydrocarbon-containing substances within and about a subterranean reservoir. The electronic seismic control device may be configured to communicate with and cooperate with a sensor provided for monitoring a subterranean reservoir and physico-chemical properties of hydrocarbon-containing substances therein, and a plurality of vibrational energy generating sources as exemplified by seismic apparatus.

According to one aspect, the software is provided with at least one algorithm configured for communicating with: (a) each of said plurality of vibrational energy generating sources for receiving therefrom electronic data characterizing the frequencies and amplitudes of vibrational energies emitted therefrom, (b) said electronic seismic control device for receiving data therefrom characterizing said manipulation of the frequencies and amplitudes of said vibrational energies, and (c) said sensing apparatus for receiving therefrom electronic data characterizing the fluidity and patterns of flow of materials, said software program configured for processing, analyzing, optimizing, reporting, storing and communicating data received therein from said seismic apparatus, said electronic seismic control device, and said sensing apparatus, said software program further configured to cooperate with said electronic seismic control device for providing thereto electronic data for further controllably manipulating the frequencies and amplitudes of the vibrational energies emitted therefrom each of said plurality of seismic apparatus.

Optimizing the frequency of the vibrational energy directed at a hydrocarbon-containing substance will cause the mobility and fluidity of the substance to increase; in other words, the substance will become more fluid, mobile and controllably flowable. On the other hand, optimizing the amplitude of the vibrational energy directed at a hydrocarbon-containing substance will create a "pushing" effect on the substance thereby urging the substance to flow along and away from the path of vibrational energy emission.

According to another aspect, the software is configured to enable the electronic seismic control device to concurrently communicate individually with each seismic apparatus whereby the frequency and amplitude of the vibrational energy produced by each seismic apparatus can be modulated differently from each of the other seismic apparatus.

According to a further aspect, it is within the scope of this invention for the software to provide means for electronically manipulating: (a) a first seismic apparatus to generate vibrational energies having high frequencies and small amplitudes directed toward a first selected portion of hydrocarbon-containing substances thereby causing the molecules comprising the substance in the selected portion to vibrate and become more fluid, and (b) a second seismic apparatus to generate vibrational energies having relatively lower frequencies and larger amplitudes directed toward a portion of the hydrocarbon-containing substance adjacent the first selected portion thereby exerting a "pushing" effect on the fluidized molecules in the first selected portion thereby creating a flow of the fluidized molecules away from the vibrational energy emitted from the second seismic apparatus.

According to yet another aspect, it is within the scope of this invention for the software to provide means for electronically manipulating: (a) a first seismic apparatus to generate vibrational energies having high frequencies and small amplitudes directed toward a first selected portion of hydrocarbon-containing substances thereby causing the molecules comprising the substance in the selected portion to vibrate and become more fluid, (b) a second seismic apparatus to generate vibrational energies having relatively lower frequencies and larger amplitudes directed toward a portion of the hydrocarbon-containing substance adjacent the first selected portion thereby exerting a "pushing" effect on the fluidized molecules in the first selected portion thereby creating a flow of the fluidized molecules away from the vibrational energy emitted from the second seismic apparatus, and (c) a third seismic apparatus to intermittently generate vibrational energies having relatively lower frequencies and larger amplitudes directed toward the same portion of the hydrocarbon-containing substance adjacent the first selected portion thereby exerting a pulsating "pushing" effect on the fluidized molecules in the first selected portion thereby precisely maneuvering the flow of the fluidized molecules away from the vibrational energy emitted from the second seismic apparatus. Furthermore, the software of the present invention may be configured to independently controllably modulate the frequency and amplitude of each seismic apparatus from a very low to a very high frequency and there between concomitantly with a very large to a very small amplitude and there between.

According to a further preferred embodiment of the present invention, there is provided a system for independently manipulating and controlling a plurality, e.g., three seismic apparatus over an extended period of time to first, cooperatively and concurrently emit high-frequency small-amplitude vibrational energies at a portion of a hydrocarbon-containing substance within a subterranean reservoir thereby increasing its fluidity and mobility, then secondly, to controllably modulate the vibrational energy emitted by one of the seismic apparatus to a lower frequency and larger amplitude wavelength thereby exerting a "pushing" effect on the mobilized portion of the hydrocarbon-containing substance which is maintained in a mobilized state by the high frequency small amplitude vibrational energies emitted by the two other seismic apparatus thereby causing it to flow, and thirdly, controllably manipulating a second seismic apparatus to modulate the vibrational energy emitted by one of the seismic apparatus to a lower frequency and larger amplitude wavelength and then to intermittently pulse the vibrational energy to controllably cause directional changes in the flow of the mobilized hydrocarbon-containing substance. It is also within scope of this invention to controllably pivot and rotate the seismic wave generating apparatus to redirect and refocus the target portion of the hydrocarbon-containing substance ahead of the mobilized and flowing portion thereby creating a pathway or channel for the flow. Accordingly, concurrently controllably manipulating and coordinating the direction of the vibrational waves emitted by each of the seismic apparatus enables precise maneuvering of the flow pathways of the mobilized hydrocarbon substance within the subterranean reservoir for example, toward and to wellbores wherein the mobilized hydrocarbon substances can be pumped to the ground surface and stored in above ground holding containments or alternatively transferred to refineries or other suitable processing facilities. Such cooperating independent manipulation of the frequencies, amplitudes, durations, direction, speed and vibratory patterns of vibrational energies generated by the plurality of seismic apparatus enables the controllable creation of multiple cooperating rolling waves of hydrocarbon-containing substances within subterranean reservoirs, and the maneuvering of the rolling waves about the reservoirs so that the hydrocarbon substances are harvested and maneuvered out of pools and lake formations within the reservoir that are separated from wellbores by elevated bottom surface regions of the reservoir, toward and to the wellbores. Furthermore, it is within the scope of this invention to controllably create areas of turbulences and/or vortexes within the mobilized and/or flowing hydrocarbon-containing substances so as to provide: (a) scrubbing of the bottom surface topography of subterranean reservoirs, and/or (b) suctioning of hydrocarbon-containing substances out of pools or crevasses in the bottom surface topography of subterranean reservoirs.

BRIEF DESCRIPTION OF THE DRAWINGS

The present invention will be described in conjunction with reference to the following drawings, in which.

DETAILED DESCRIPTION OF THE INVENTION

Figure 1:
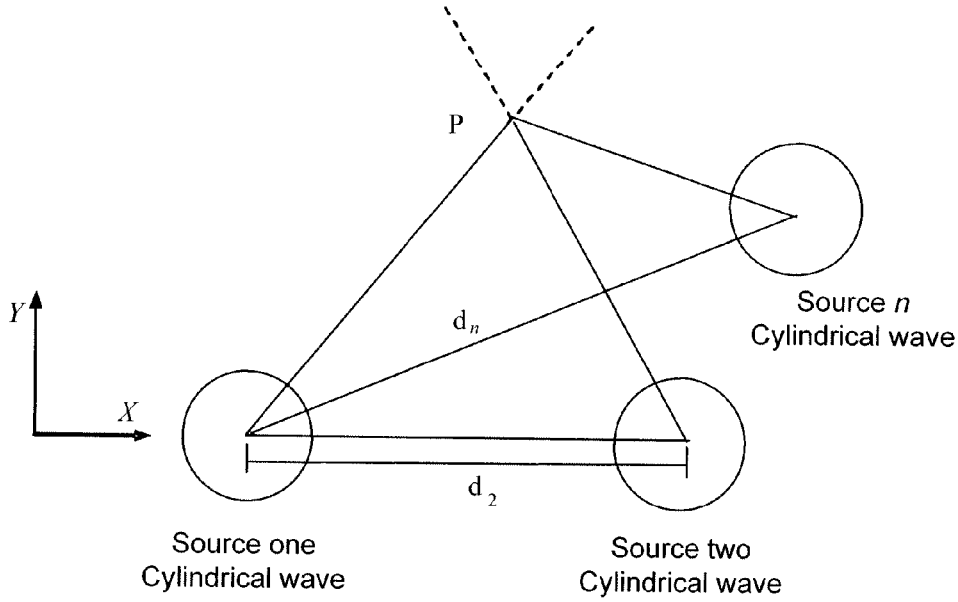
FIG. 1 is a prior art Two-Source Model in computation.

1. Expressions of wave equations in polar coordinate system

Determination of the relative displacements between the solid and fluid of a fluid saturated porous medium is a key aspect of the present invention. To analyze the relative displacements, focus is given to a specific geometric point in the porous medium considered for its relative displacement between the fluid and solid, and the combined effects of the waves of different energy sources on the displacements of the solid and fluid. A 2D model is developed to simulate the real field, and it is convenient for the governing equations and corresponding solutions to be expressed in isotropic polar coordinates. In isotropic polar coordinates, the operators, $\nabla$ and $\nabla^2$ are given as:

$$\begin{cases} \nabla = \left(\frac{\partial}{\partial r} + \frac{1}{r}\right)\vec{r} \\ \nabla^2 = \left(\frac{\partial^2}{\partial r^2} + \frac{1}{r}\frac{\partial}{\partial r}\right) \end{cases} \tag{13a, b}$$

Substitute Eq. (13) into Eq. (9), the equations for dilatational waves can be written as:

$$\begin{cases} \left(\frac{d^2}{dr^2} + \frac{1}{r}\frac{d}{dr}\right)(\sigma_{11}u + \sigma_{12}U) = \\ \frac{1}{V_c^2}\frac{\partial^2}{\partial t^2}(\gamma_{11}u + \gamma_{12}U) + \frac{b}{H}\frac{\partial}{\partial t}(u - U) \\ \left(\frac{d^2}{dr^2} + \frac{1}{r}\frac{d}{dr}\right)(\sigma_{12}u + \sigma_{22}U) = \\ \frac{1}{V_c^2}\frac{\partial^2}{\partial t^2}(\gamma_{12}u + \gamma_{22}U) - \frac{b}{H}\frac{\partial}{\partial t}(u - U) \end{cases} \tag{14a, b}$$

For the sake of convenience of derivation process, the following parameters are used as introduced by Biot (1956a), $$V_c^2 = H/\rho \tag{15}$$

$$\begin{cases} \sigma_{11} = \dfrac{P}{H}, \quad \sigma_{12} = \dfrac{Q}{H}, \quad \sigma_{22} = \dfrac{R}{H} \\ \gamma_{11} = \dfrac{\rho_{11}}{\rho}, \quad \gamma_{12} = \dfrac{\rho_{12}}{\rho}, \quad \gamma_{22} = \dfrac{\rho_{22}}{\rho} \end{cases} \tag{16}$$

in which $$H=P+R+2Q,\ \rho=\rho_{11}+\rho_{22}+2\rho_{12} \tag{17}$$

According to Sommerfeld Radiation Condition (Pao and Mow., 1973, Diffraction of Elastic Waves and Dynamic Stress Concentration, Crane-Russak Inc., New York), the wave propagating from a cylindrical source can be assumed as:

$$\begin{cases} u = C_1 H_0^{(1)}(lr)\exp(-i\omega t) \\ U = C_2 H_0^{(1)}(lr)\exp(-i\omega t) \end{cases} \tag{18a, b}$$

$C_1$ and $C_2$ are the displacement amplitudes of solid and fluid, respectively; l is wave number; r is the distance from the considered point to the source. $H_0^{(1)}(\bullet)$ is the zero-order Hankel function of the first kind. The subscript '0' represents zero order, in the following equations these subscripts have the same meaning; the superscript '(1)' means the function is the first kind. $\exp(-i\omega t)$ is the time factor of the harmonic wave; $i=\sqrt{-1}$ is the complex unit; ω is the frequency of wave. It should be noted that the wave expression is now in the form of displacement of the fluid and solid in comparing with the volume strain given by Biot (1956a).

Employing the following basic equations (Andrews et al., 2001, Special Functions, Cambridge University Press, Cambridge):

$$\begin{cases} \dfrac{d}{dx} H_0^{(1)}(x) = -H_1^{(1)}(x) \\ \dfrac{d}{dx} H_1^{(1)}(x) = \dfrac{1}{2}[H_0^{(1)}(x) - H_2^{(1)}(x)] \end{cases} \tag{19a, b}$$

one may obtain $$\begin{cases} \dfrac{\partial^2}{\partial r^2} H_0^{(1)}(lr) = -\dfrac{l^2}{2}[H_0^{(1)}(lr) - H_2^{(1)}(lr)] \\ \dfrac{1}{r}\dfrac{\partial}{\partial r} H_0^{(1)}(lr) = -\dfrac{l^2}{2}[H_0^{(1)}(lr) + H_2^{(1)}(lr)] \end{cases} \tag{20a, b}$$

which may also be expressed in the following form:

$$\nabla^2 H_0^{(1)}(lr) = \left(\frac{\partial^2}{\partial r^2} + \frac{1}{r}\frac{\partial}{\partial r}\right) H_0^{(1)}(lr) = -l^2 H_0^{(1)}(lr) \tag{21}$$

By substituting expressions of Eq. (18) into Eq. (14), the following equations can be obtained:

$$\begin{cases} -l^2(\sigma_{11}C_1 + \sigma_{12}C_2) = - \\ \dfrac{1}{V_c^2}\omega^2(\gamma_{11}C_1 + \gamma_{12}C_2) - \dfrac{i\omega b}{H}\dfrac{\partial}{\partial t}(C_1 - C_2) \\ -l^2(\sigma_{12}C_1 + \sigma_{22}C_2) = - \\ \dfrac{1}{V_c^2}\omega^2(\gamma_{12}C_1 + \gamma_{22}C_2) + \dfrac{i\omega b}{H}\dfrac{\partial}{\partial t}(C_1 - C_2) \end{cases} \tag{22a, b}$$

The general equation of velocities for these waves can be expressed as:

$$V=\omega/l, \tag{23}$$

For the sake of simplification, introduce a parameter:

$$\xi=V_c^2/V^2 \tag{24}$$

therefore, Eq. (22) can be rewritten as:

$$\begin{cases} \xi(\sigma_{11}C_1 + \sigma_{12}C_2) = \gamma_{11}C_1 + \gamma_{12}C_2 + \dfrac{ibV_c^2}{H\omega}\dfrac{\partial}{\partial t}(C_1 - C_2) \\ \xi(\sigma_{12}C_1 + \sigma_{22}C_2) = \gamma_{12}C_1 + \gamma_{22}C_2 - \dfrac{ibV_c^2}{H\omega}\dfrac{\partial}{\partial t}(C_1 - C_2) \end{cases} \tag{25a, b}$$

Substitution of Eq. (18) into Eq. (1) and elimination of the constants $C_1$ and $C_2$ yield the relation:

$$(PR - Q^2)\frac{l^4}{\omega^4} - (P\rho_{11} + P\rho_{22} - 2Q\rho_{12})\frac{l^2}{\omega^2} + \rho_{11}\rho_{22} - \rho_{12}^2 + \frac{ib}{\omega}\left[(P + R + 2Q)\frac{l^2}{\omega^2} - \rho\right] = 0 \tag{26}$$

With the variables already introduced, substitution of Eq. (18) into Eq. (25) and elimination of the constants $C_1$ and $C_2$ yield a non-dimensional equation with one single variable ζ:

$$(\sigma_{11}\sigma_{12} - \sigma_{12}^2)\zeta^2 - (\sigma_{11}\gamma_{12} + \sigma_{22}\gamma_{11} - 2\sigma_{12}\gamma_{12})\zeta + (\gamma_{11}\gamma_{22} - \gamma_{12}^2) + \frac{ib}{\omega\rho}(\zeta - 1) = 0 \tag{27}$$

with $$\zeta = \frac{l^2}{\omega^2}V_c^2 \tag{28}$$

In this case l and ζ are complex variables. $V_c=H/\rho$ is the reference velocity. Denoting and $\zeta_I$ and $\zeta_{II}$ are the roots of Eq. (27), which correspond to the velocities of the purely elastic waves as given by Eq. (1), and assume that $\zeta_I$ is the root which corresponds to the first compression wave, while $\zeta_{II}$ is that corresponds to the second wave. $\zeta_I$ and $\zeta_{II}$ have the following expressions:

$$(\zeta_I)^{1/2}=R_I+iT_I \tag{29}$$

$$(\zeta_{II})^{1/2}=R_{II}+iT_{II}$$

The phase velocities of the compression waves can be given by equations:

$$v_I/V_c=1/|R_I| \tag{30}$$

$$v_{II}/V_c=1/|R_{II}| \tag{31}$$

By solving the quadratic equations of Eq. (27) related to the velocities, two complex roots can be obtained; the image parts reflect the attenuation; while the real parts designate the propagation velocities of the waves. It should be noted that this velocities is the phase speeds, and not the speed of the particle vibration. The ratio of the image part to the real part is important since it describes the degree of damping of the wave.

2. Multi-Source Model Development

The prior art concentrates on studies where there is merely a single source in the consideration domain, i.e. no wave superposition is studied. However, in most common practice, whether the energy from one source is not strong enough, or the desired purpose cannot be obtained by putting just one source in the considered domain, several energy sources can be put in the domain in the real world. Thus, it is more significant and practically meaningful to study the dynamic response of porous media and the relative displacement between solid and fluid when the domain is excited by multiple energy sources. From each of the energy sources, a cylindrical wave is generated and will propagate in the porous medium. Therefore, a model with multiple sources provides a more accurate analysis of superposition wave field. A newly developed moving coordinate method can be employed in building such model and describing the displacement field excited by multiple waves.

As a starting point, it is supposed there are cylindrical compressible waves generated by multiple cylindrical sources, as shown in FIG. 1. The waves are assumed to be continuous and harmonic, and the waves are in steady state. Moreover, all the waves can be expressed in their own local coordinates with the origins locating at the sources. Under these conditions, the wave from each of the multi-energy sources can be expressed in local coordinates. As shown in FIG. 1, if the global coordinates are located at one source, then, the coordinates of other source locations can be expressed by $d_j=r_{j0}(\cos\theta_{j0}+i\sin\theta_{j0})$. All the energy sources considered in the present invention disclosed herein are supposed to be continuous and harmonic cylindrical waves generated by multiple cylindrical sources. Furthermore, only steady state is considered. The waves can therefore have the following expressions if they are expressed in their own local coordinates with the origins locating at the sources:

$$\begin{cases} u_r = u_0\mathrm{Re}[H_0^{(1)}(lr)\exp(-i\omega t)](\cos\theta + i\sin\theta) \\ U_r = U_0\mathrm{Re}[H_0^{(1)}(lr)\exp(-i\omega t)](\cos\theta + i\sin\theta) \end{cases} \tag{32}$$

in which, the term $(\cos\theta+i\sin\theta)$ is introduced to represent the direction of the displacement vector. Consequently, this term can be replaced by $[z/|z|]$. z has the expression, $z=x+iy$, with $x=r\cos\theta$ and $y=r\sin\theta$ in the polar coordinate system.

Thus, the waves propagating from each of the sources can be expressed by the following formulas:

$$\begin{cases} u_{r1} = u_{01}\mathrm{Re}[H_0^{(1)}(l_1 r_1)\exp(-i\omega_1 t)]\left[\frac{z_1}{|z_1|}\right] \\ U_{r1} = U_{01}\mathrm{Re}[H_0^{(1)}(l_1 r_1)\exp(-i\omega_1 t)]\left[\frac{z_1}{|z_1|}\right] \end{cases} \text{(Wave One)} \tag{33a, b}$$

and $(\cos\theta + i\sin\theta)$ $$\begin{cases} u_{r2} = u_{02}\mathrm{Re}[H_0^{(1)}(l_2 r_2)\exp(-i\omega_2 t)]\left[\frac{z_2}{|z_2|}\right] \\ U_{r2} = U_{02}\mathrm{Re}[H_0^{(1)}(l_2 r_2)\exp(-i\omega_2 t)]\left[\frac{z_2}{|z_2|}\right] \end{cases} \text{(Wave Two)} \tag{34a, b}$$

...

$$\begin{cases} u_m = u_{0n}\mathrm{Re}[H_0^{(1)}(l_n r_n)\exp(-i\omega_n t)]\left[\frac{z_n}{|z_n|}\right] \\ U_m = U_{0n}\mathrm{Re}[H_0^{(1)}(l_n r_n)\exp(-i\omega_n t)]\left[\frac{z_n}{|z_n|}\right] \end{cases} \text{(Wave } n\text{)} \tag{35a, b}$$

Here, $u_{0j}$ and $U_{0j}$ (j=1, 2, . . . , n) are respectively the displacement amplitudes of the solid and fluid of the $j^{th}$ source. $u_{0j}$ and $U_{0j}$ (j=1, 2, . . . , n) are respectively the displacement vectors of solid and fluid excited by the $j^{th}$ source. $z_j=x_j+iy_i$, is a complex variable, and $r_j=|z_j|$, is the distance from a point P to the $j^{th}$ wave sources; the term $[z_j/|z_j|]$ is introduced to describe the direction of the displacements.

In order to investigate the superposed action of multiple waves conveniently, the expression for each wave is to be written in a common coordinate system by using the moving-coordinate method (Wang, 2002, J. Earthquake Eng. Eng. Vibr., 1: 36-44).

Expressing wave j in the xoy-coordinates as shown in FIG. 1, $z_j=z-d_j$:

$$\begin{cases} u_{rj} = u_{0j}\mathrm{Re}[H_0^{(1)}(l_j r_j)\exp(-i\omega_j t)]\left[\frac{z_j}{|z_j|}\right] \\ \quad = u_{0j}\mathrm{Re}[H_0^{(1)}(l_j|z-d_j|)\exp(-i\omega_j t)]\left[\frac{z-d_j}{|z-d_j|}\right] \\ U_{rj} = U_{0j}\mathrm{Re}[H_0^{(1)}(l_j r_j)\exp(-i\omega_j t)]\left[\frac{z_j}{|z_j|}\right] \\ \quad = U_{0j}\mathrm{Re}[H_0^{(1)}(l_j|z-d_j|)\exp(-i\omega_j t)]\left[\frac{z-d_j}{|z-d_j|}\right] \end{cases} \tag{36a, b}$$

$d_j$ are the coordinates of the $j^{th}$ wave source in the common coordinates.

With the equations developed, the total displacements of any given point, P, in the domain considered can be described in a common coordinate system. xoy-coordinates can be considered as the common coordinates (also named global coordinates). This implies that $d_1=0$. The combined displacements can now be presented by:

$$\begin{cases} u_r = \sum_{j=1}^{n} u_{rj} = u_{01}\mathrm{Re}[H_0^{(1)}(l_1|z_1|)\exp(-i\omega_1 t)]\left[\frac{z_1}{|z_1|}\right] + \cdots + \\ \qquad u_{0n}\mathrm{Re}[H_0^{(1)}(l_n|z-d_n|)\exp(-i\omega_n t)]\left[\frac{z-d_n}{|z-d_n|}\right] \\ U_r = \sum_{j=1}^{n} U_{rj} = U_{01}\mathrm{Re}[H_0^{(1)}(l_1|z_1|)\exp(-i\omega_1 t)]\left[\frac{z_1}{|z_1|}\right] + \cdots + \\ \qquad U_{0n}\mathrm{Re}[H_0^{(1)}(l_n|z-d_n|)\exp(-i\omega_n t)]\left[\frac{z-d_n}{|z-d_n|}\right] \end{cases} \tag{37a, b}$$

The displacement wave field excited by multiple cylindrical sources can be quantified by using the model provided above. The characteristics of the wave field can be analyzed quantitatively when the parameters of material and the sources or the locations of the sources are specified.

3. Numerical Simulation

Figure 2:
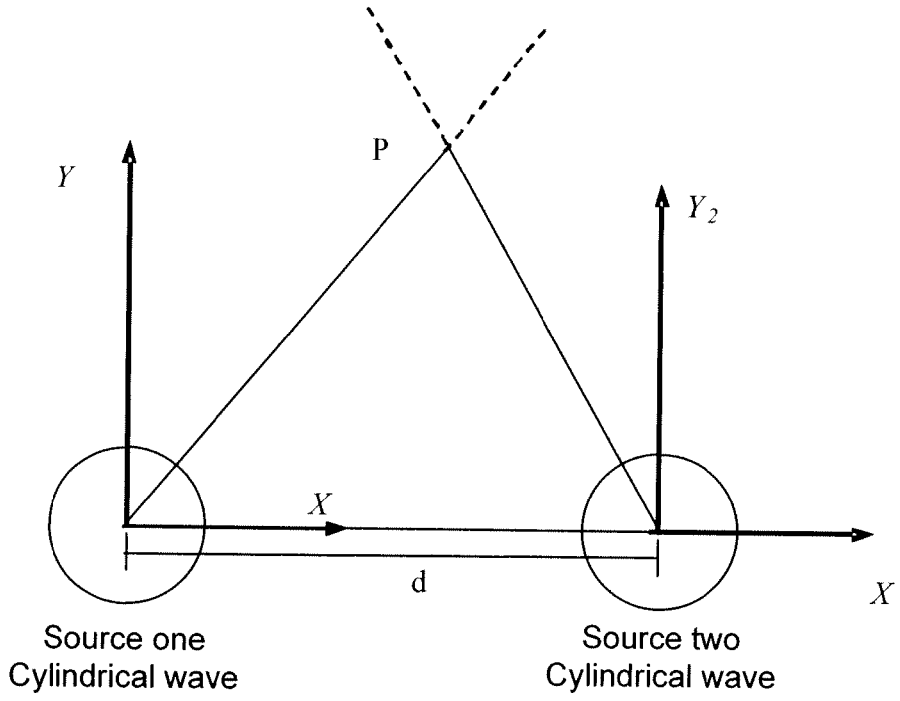
FIG. 2 is a Multi-Source Model of the present invention.

To demonstrate the application of the model established, numerical simulations are performed as the basis of the wave model and the solutions developed. A numerical simulation for the wave generated by two energy sources is shown in FIG. 2. The distance between the two sources is noted as d, the position of point P in the field is expressed as: $z=x+iy$, the frequencies of the two source waves are $\omega_1$ and $\omega_2$ respectively. For the sake of simplification, it is assumed that the solid skeleton system is formed by spherical solid particles as the assumption made by the other researches conventionally. The particles' compressibility can be neglect. The parameters A, P, Q, and R in Eq. (1) have the following forms (Lin et al., 2001):

$$A = \frac{2\nu_s}{1-2\nu_s}\mu_s + \frac{(1-\phi)^2}{\phi}K_f \tag{38}$$

$$P = A + 2\mu_s \tag{39}$$

$$Q = (1-\phi)K_f \tag{40}$$

$$R = \phi K_f \tag{41}$$

where $\mu_s$ is the shear modulus of the material; $\nu_s$ is the Poisson ratio of the solid.

Once the physical parameters are given, the coefficient values of waves can be determined by the wave model established. Table 1 gives the parameter values used in the numerical computation. Table 2 shows the values of wave velocities and amplitudes and their ratios calculated.

TABLE 1

The values of parameters of the porous medium

| $\Phi$ | $\mu$ | $\nu_s$ | $\mu_s$ | $K_f$ | $\rho_s$ | $\rho_f$ | $\mu_s/K_f$ |
|---|---|---|---|---|---|---|---|
| 0.246 | 5 cp | 0.29 | 10.0 GPa | 2.4 GPa | 2700 kg/m$^3$ | 1000 kg/m$^3$ | 4.17 |

TABLE 2

The values of parameters of the waves

| Frequency | $V_{fast}$ | $V_{slow}$ | Attenuation ratio I | Attenuation ratio II | $V_{fast}/V_{slow}$ | $C_1/C_2$* |
|---|---|---|---|---|---|---|
| 5 Hz | 4400 m/s | 114 m/s | 0.0053 | 0.7214 | 38.47 | 1.258 |

*C1/C2: The ratio of amplitudes of solid to fluid.

Figure 3:
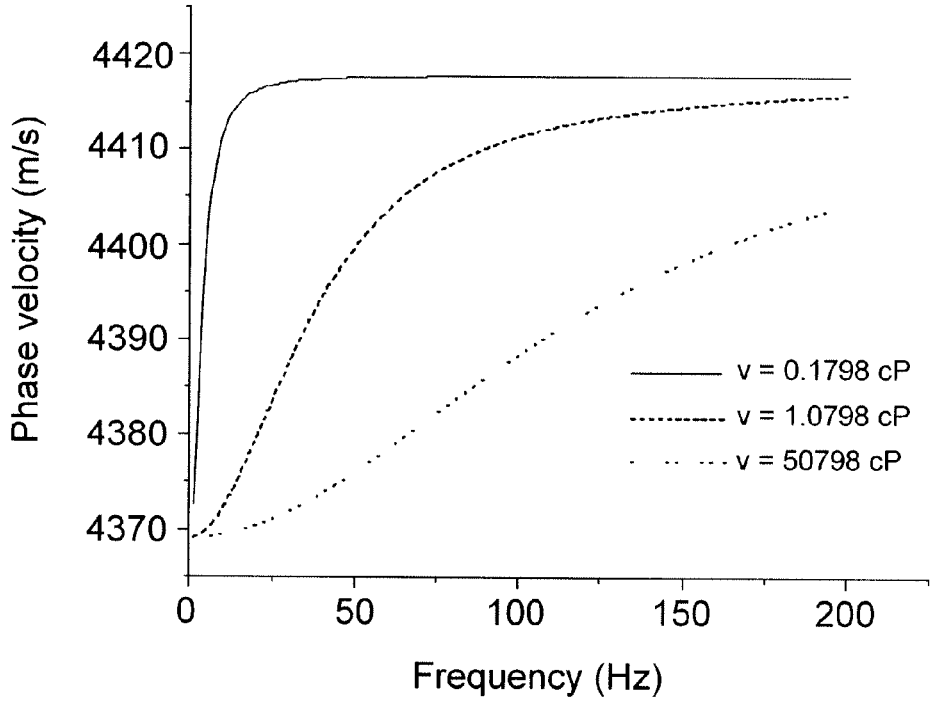
FIG. 3 is a graph showing phase velocity changes vs. frequency with different viscosities.
Figure 4:
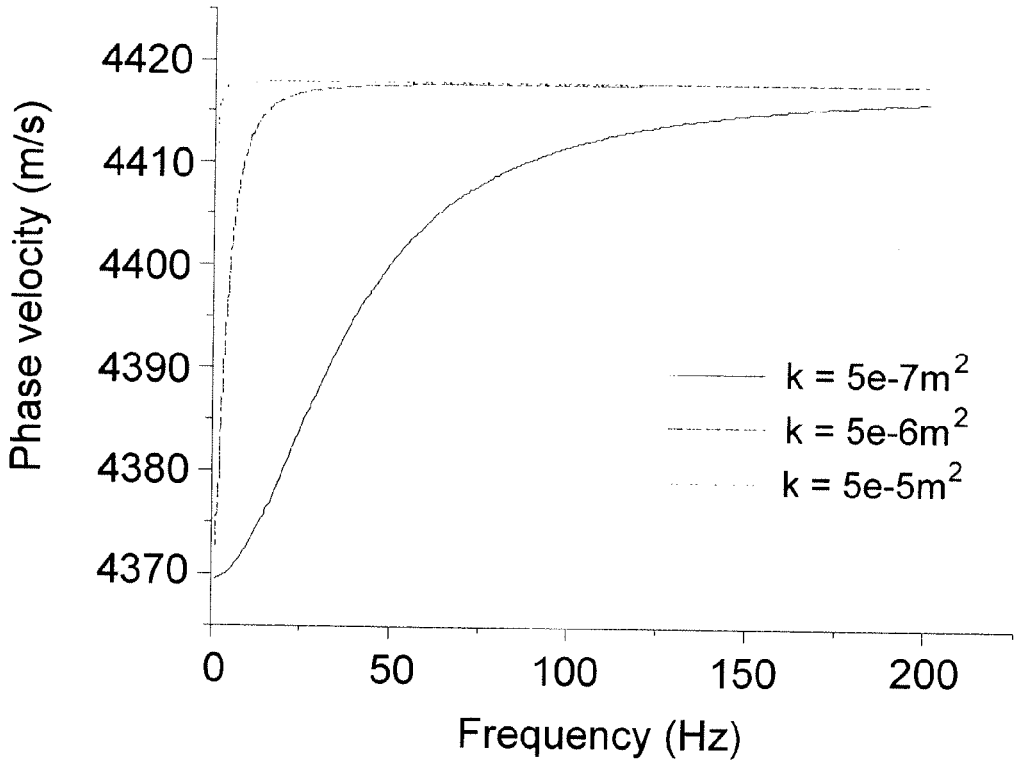
FIG. 4 is a graph showing phase velocity changes vs. frequency with different permeabilities.

The phase velocity of the wave and the relative displacements of a random point P in the wave field are computed. The comparison between the results with the consideration of fluid viscosity and result without the concern of viscosity of the fluid is also performed. FIG. 3 and FIG. 4 show the phase velocity changes versus the frequency of the wave in a porous medium. One can see from these figures that with the increase of frequency, the velocity of wave will rise. In the low frequency region, the velocity increases more quickly than in the high frequency region. Also from FIG. 3, for the same frequency, the larger of the viscosity of the fluid the larger of the velocity; and from FIG. 4, the higher of the permeability of the porous medium, the larger of the velocity.

Figure 5:
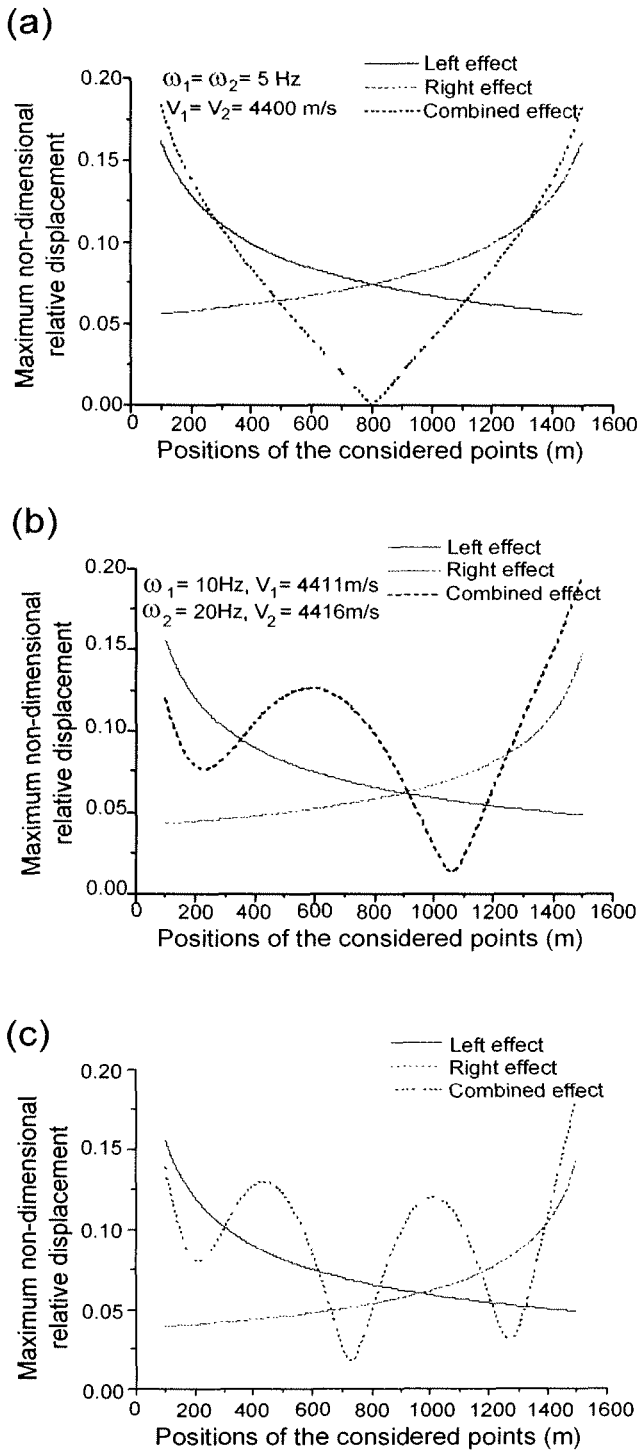
FIGS. 5(*a*)-(*c*) are graphs showing the effects of frequency modulations on the maximum non-dimensional relative displacement changes vs. location of the concerned points.

FIG. 5 shows the non-dimensional relative displacement amplitudes along the line connecting the two sources. The non-dimensional relative displacement used in FIG. 5 is defined by (U−u)/u. The locations of the two sources are at x=0, y=0 and x=1600 m, y=0 respectively. It should be noted that, for each of the waves, the amplitudes of the wave decrease in general with the increasing distance from the energy source. Moreover, the amplitude of the combined wave at steady state is not simply the summation of the amplitudes of the two waves. As can be seen from FIG. 5, when the porous medium is excited by two energy sources, the wave response (maximum amplitudes of the displacements) is totally different from that of the single source (represented by the curves of "left effect" and "right effect" respectively). For some areas, the amplitude of the combined wave is smaller than that of single source, while for some other areas the amplitude is larger than that of the single source. One may also find from the figure that the amplitude of the wave can be zero at a certain location between the two sources. It is also noted that the frequency of the resulting wave generated by the two energy sources are varied from the frequencies of the two energy sources.

Figure 6:
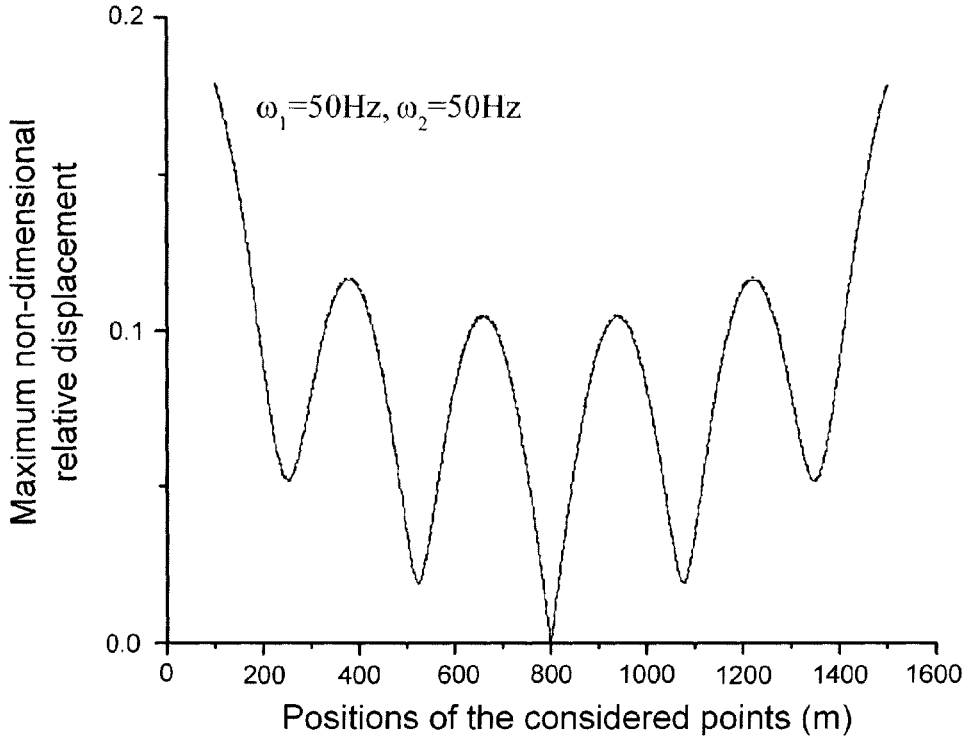
FIG. 6 is a graph showing comparisons of maximum non-dimensional relative displacement changes vs. location of the concerned point.

The comparison between the results from two cases with and without the consideration of the fluid viscosity is illustrated in FIG. 6. One can find the effect of viscosity of on the relative displacement is very slight, and can be neglected.

Figure 7:
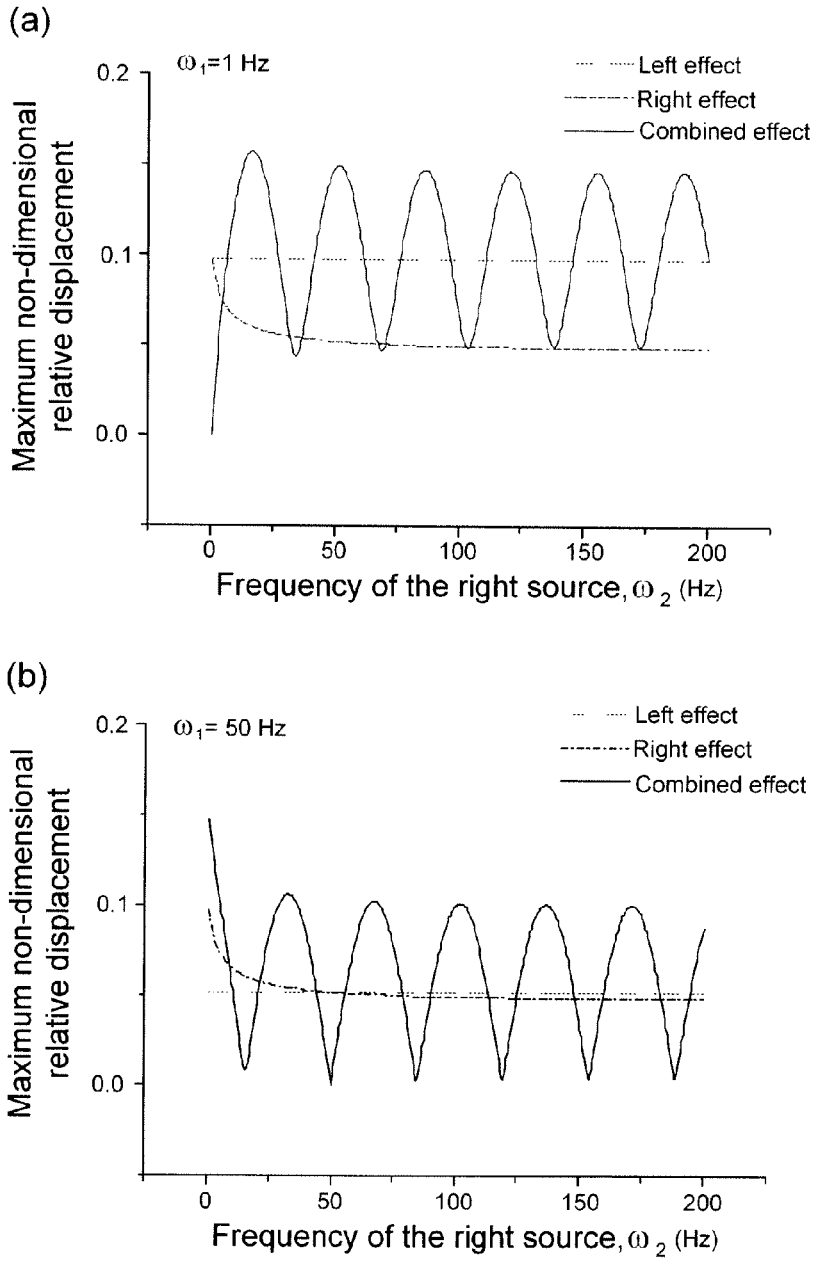
FIGS. 7(*a*) and (*b*) are graphs showing maximum relative displacements vs. frequency of the right source.

Effect of the source frequencies on the wave propagation is shown in FIG. 7, in which the relative displacement of the middle point of the connecting line between the two sources is plotted with respect to the change of the frequency of the right energy source. The selected point in FIG. 7 is located at the middle of the line, x=800 m, y=0 with unit of meter, while the distance between the two sources is 1,600 meters. As illustrated in FIG. 7, the non-dimensional relative displacement of the point becomes relatively stable with the increase of the frequency of the second source. At the steady state, the relative displacement varies periodically as shown in the figure. Quantitatively, the maximum relative displacement of this point can be twice as that of the single source, whereas the minimum relative displacement is almost zero.

Figure 8B:
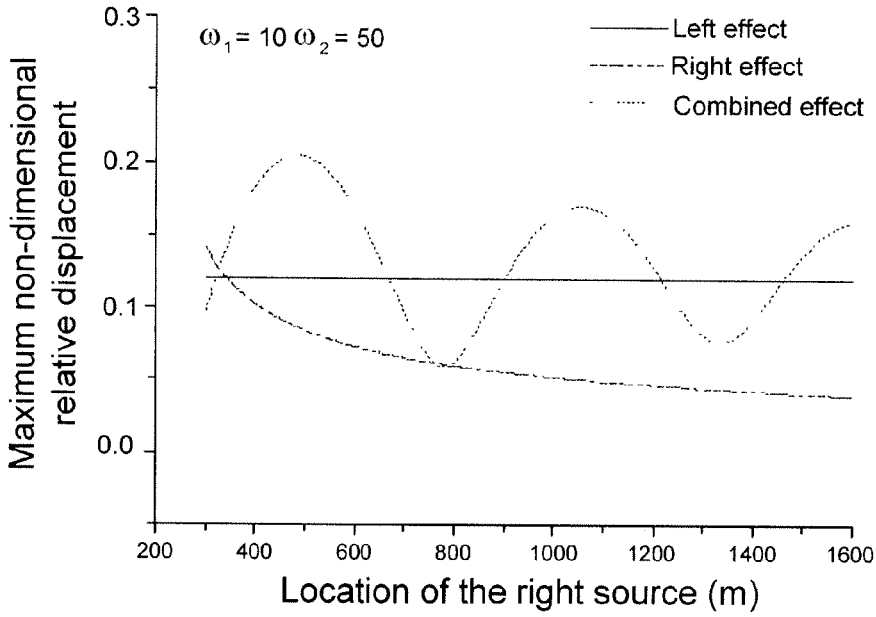
FIGS. 8(*a*) and (*b*) are graphs showing maximum relative displacements vs. location of the right source with respect to the location of the left source.
Figure 8:
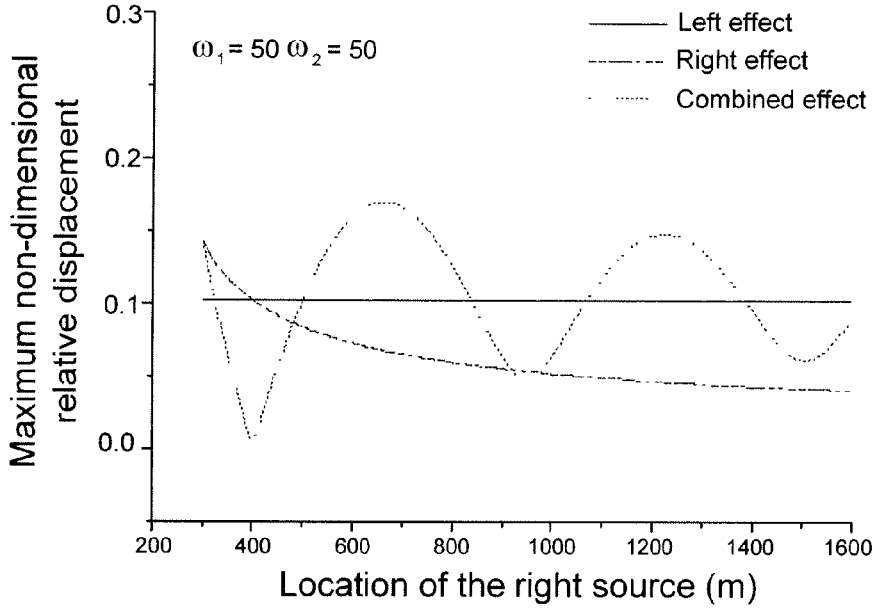
Figure 9:
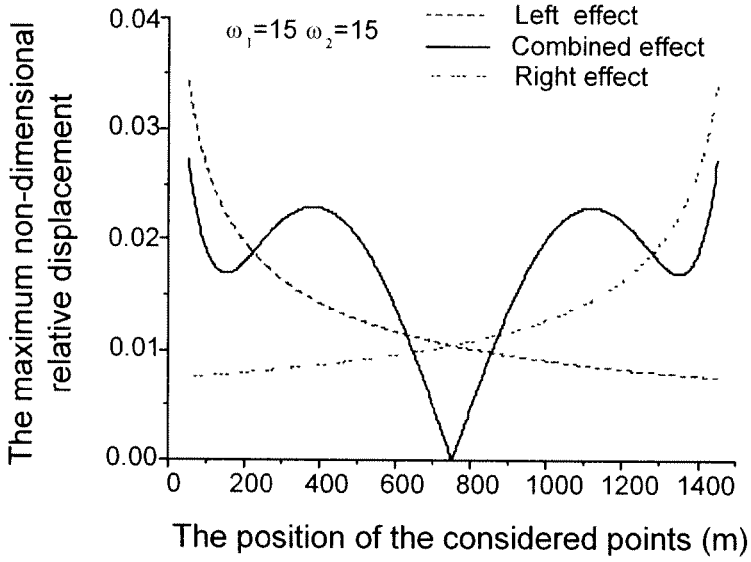
FIG. 9 is a graph showing the maximum relative displacements along the connected line.
Figure 9:
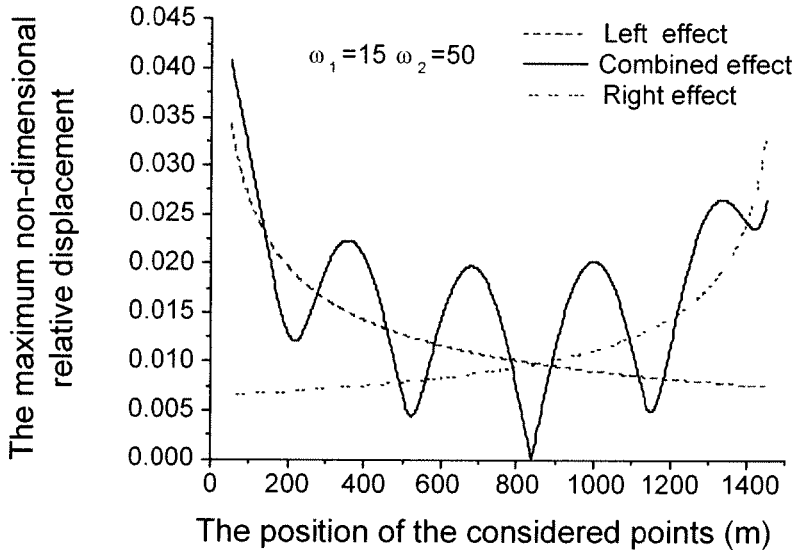

Effects of distance between the two sources on the wave motion of the porous medium are also evaluated in the present invention. FIG. 8 shows the relative displacement of a point at x=200 m, y=0, with respect to the excitations of the left source with a constant distance from the point and the right source with a varying distance from the point. As exhibited in the figures that the effect of the right source decreases as the distance between the concerned point and the right source increases. It may also be observed from the figure that the peak value of the relative displacement varies periodically with the increase of the distance between the right source and the point considered.

Figure 10:
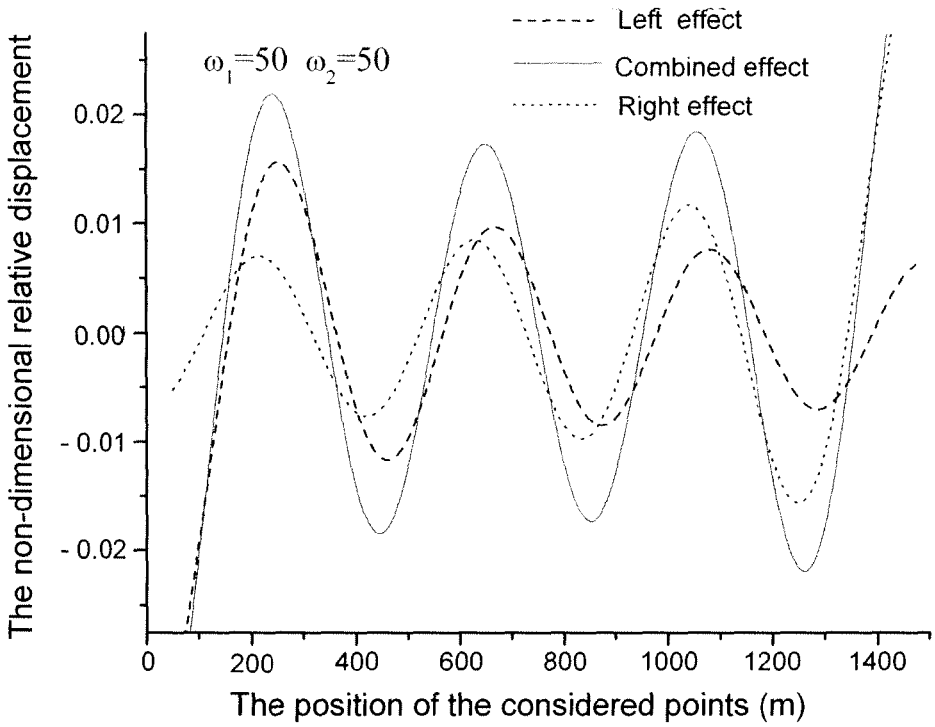
FIG. 10 is a graph showing the maximum relative displacements at a specified time.

As described previously, the relative displacements can be quantified at any specified time for any given point in the considered domain by using the methodology of the present invention disclosed herein. The relative displacements of the porous medium along the line connecting the two resources also form a wave at any specified time, as shown in FIG. 10 for a case calculated. One sees that the combined effect can be smaller as well as larger than the effect just by one source.

Figure 11:
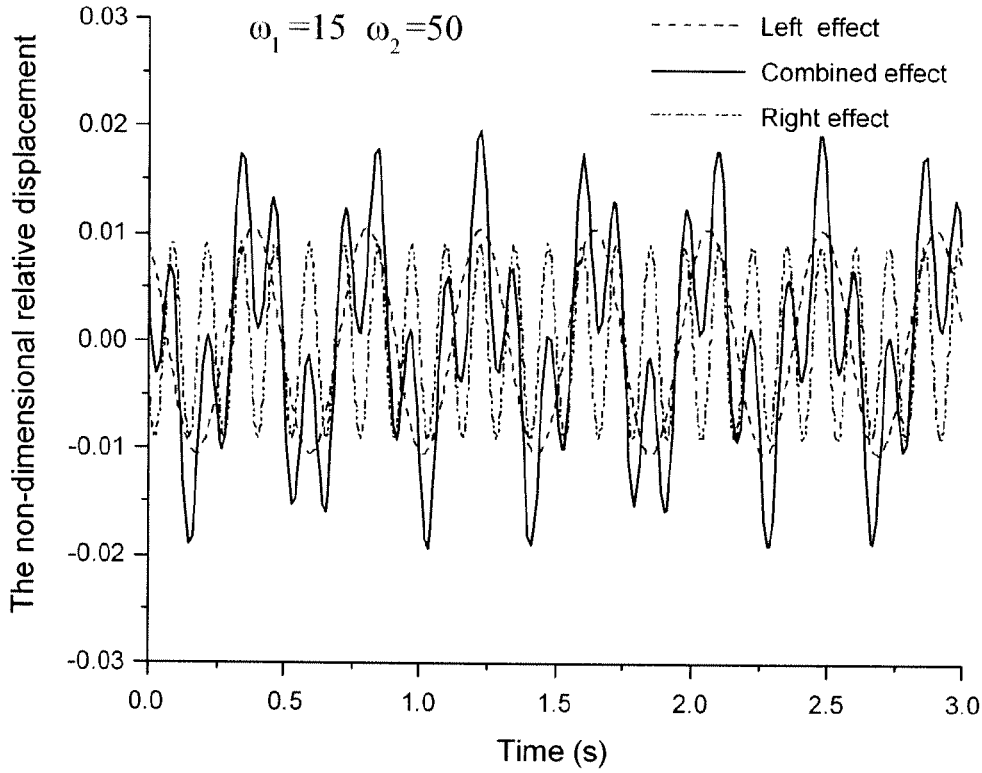
FIG. 11 as a graph showing the relative displacements in a time span.

For any selected point in the domain, the relative displacement history of the point can be determined with the solutions derived. FIG. 11 shows an example of the calculation. The selected point in FIG. 5 is located at x=750, y=0 with unit of meter, while the distance between the two sources is 1,500 meters. For this specific case, as can be seen from the figure, the resulting wave generated by the two sources with identical frequency appears as a periodic motion. But the frequency of the superposed wave is different from these of the two source waves.

Figure 12:
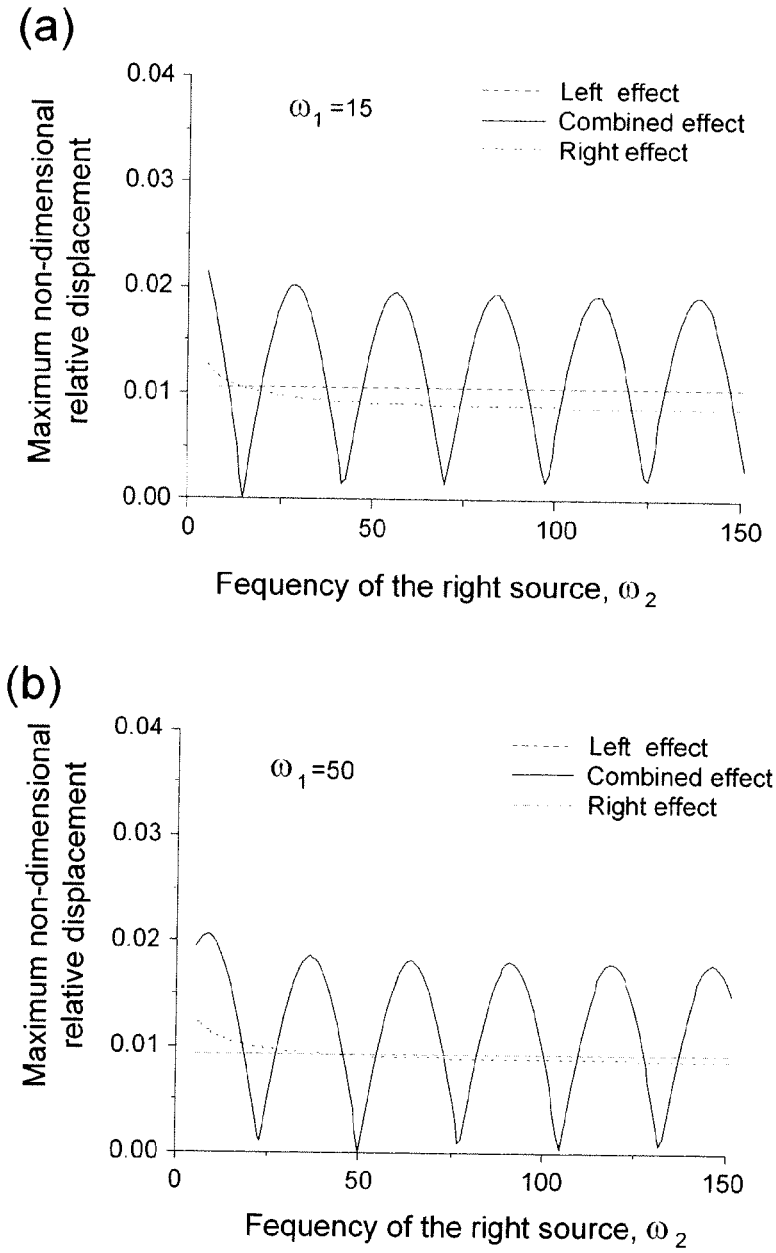
FIG. 12 is a graph showing the maximum relative displacements vs. frequency of the right source.

Effect of the source frequencies on the wave propagation is shown in FIG. 12 in which the relative displacement of the middle point of the connecting line between the two sources is plotted with respect to the change of the frequency of the right energy source. The distance between the two sources is 1,500 m. As illustrated in FIG. 12, the non-dimensional relative displacement of the point becomes relatively stable with the increase of the frequency of the second source. It should be noted that the frequencies and amplitudes of the two sources are not changing with time once they are specified. As the relative displacement becomes stable, the magnitude of the relative displacement appears as varying periodically as shown in the figure. Quantitatively, the maximum relative displacement of this point can be twice as that of the single source, whereas the minimum relative displacement is almost zero.

Figure 13:
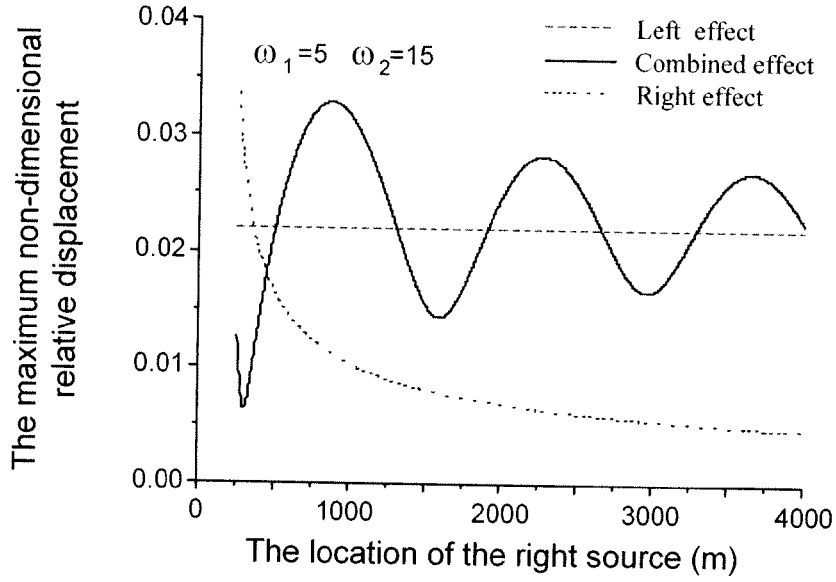
FIG. 13 is a graph showing maximum relative displacements vs. location of the right source with respect to the location of the left source.
Figure 13:
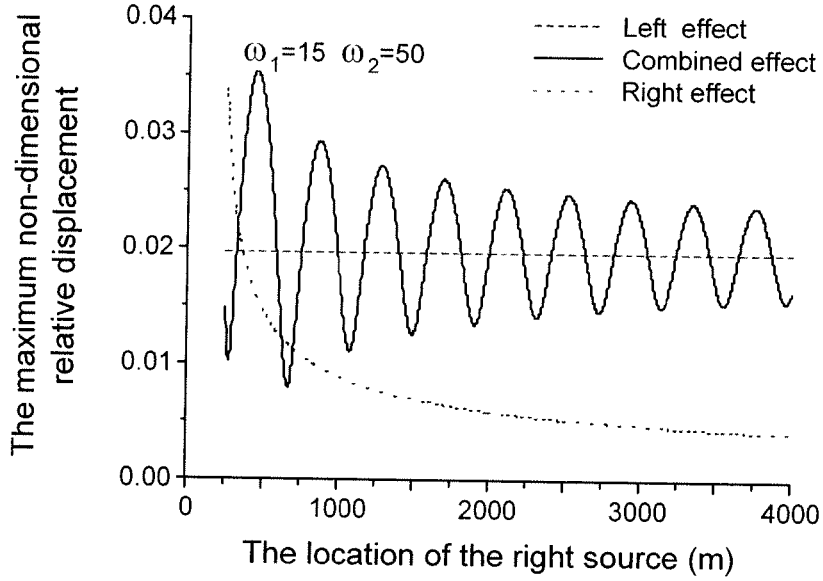

Effects of distance between the two sources on the wave motion of the porous medium are also evaluated in the present invention. FIG. 13 shows the relative displacement of a point at x=200, y=0, with respect to the excitations of the left source with a constant distance from the point and the right source with a varying distance from the point. As exhibited in the figures that the effect of the right source decreases as the distance between the concerned point and the right source increases. It may also be observed from the figure that the peak value of the relative displacement varies periodically with the increase of the distance between the right source and the point considered.

Figure 14:
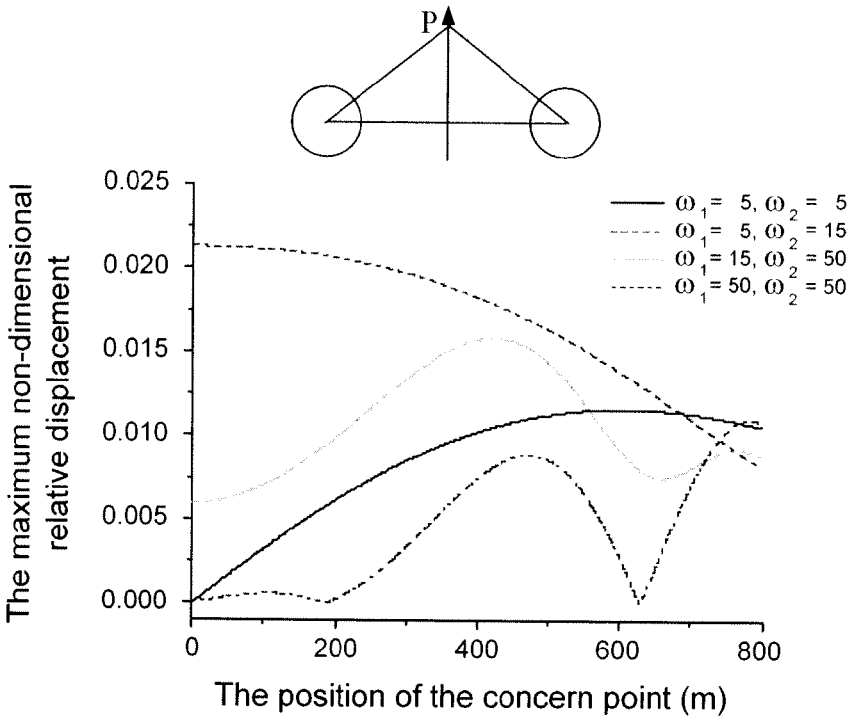
FIG. 14 is a graph showing maximum relative displacements of the points along the line perpendicular and passing through the midpoint of the line connecting the two sources.
Figure 15:
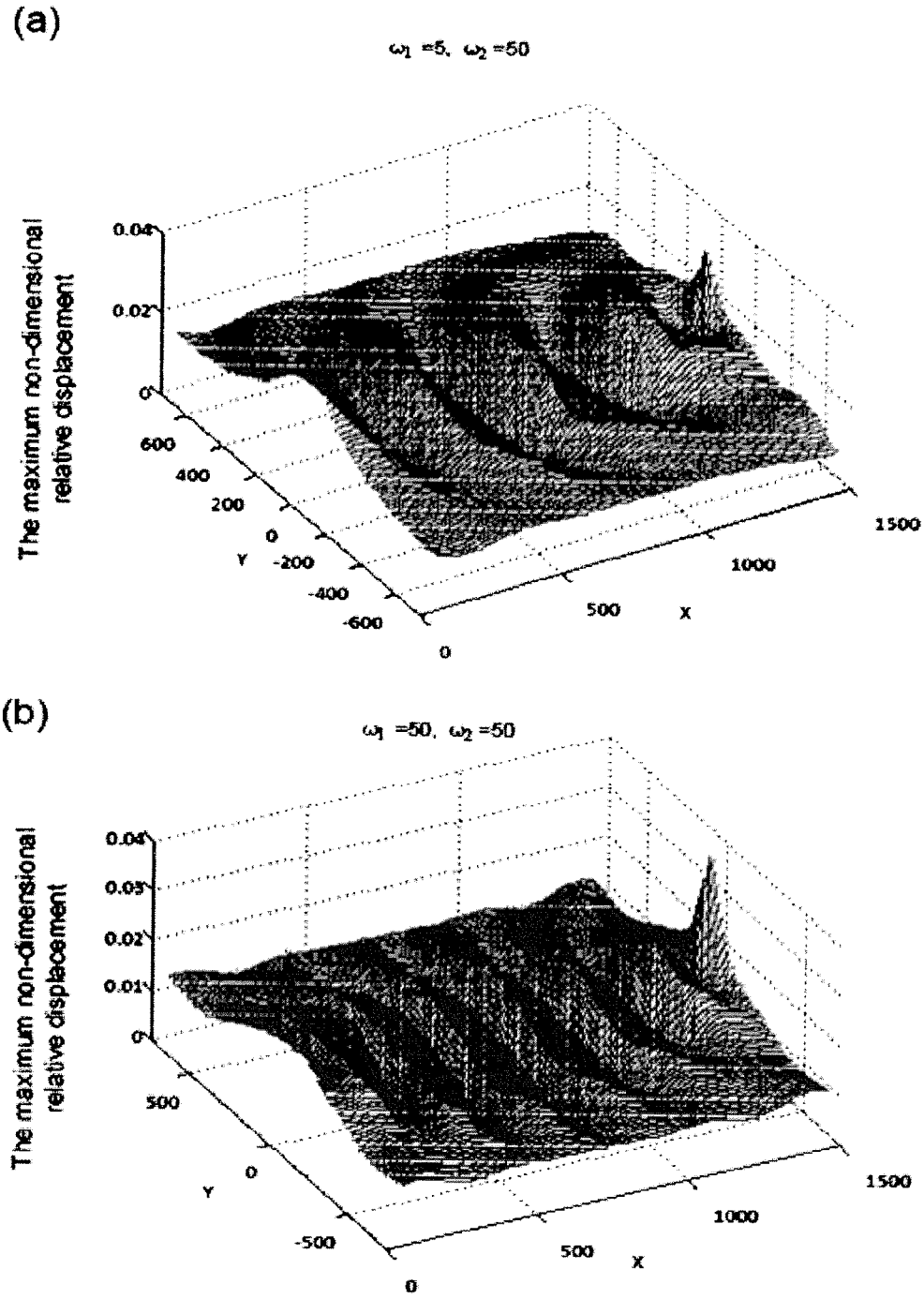
FIG. 15 is a graph showing the maximum relative displacement field excited by the two sources.

It should be noted that the equations disclosed herein can be used to calculate for the motion of a randomly selected particle of the porous medium considered. This implies that the three-dimensional displacement field of the porous medium subjected to multi-energy sources can be numerically determined with the equations at any specified time. The wave propagations and superposed action in the porous medium consisting fluid and solid can therefore be quantified. FIG. 14 shows the relative displacements of the points along the perpendicular bisector of the line joining the sources, corresponding to the various frequencies of the sources.
of the line connecting the two sources FIG. 15 illustrates a 3D wave shape of the relative displacement field of a 2D plane. The frequencies of the two sources are $\omega_1=5$, $\omega_2=50$ respectively; one wave locates at x=0, y=0, while the other one locates at x=1500, y=0. The vertical axis of the figures is the maximum values of the non-dimensional relative displacement with respect to different source frequencies.

4. Conclusions

The invention disclosed herein provides methods, apparatus and systems for stimulating wave motion and vibrations of the fluid and solid in a fluid-saturated elastic porous medium. The present invention provides means for affecting the mobility and fluidity of hydrocarbon-containing substances within subterranean reservoirs, and for manipulating the maneuverability of the flows of mobilized hydrocarbon-containing substances within and about subterranean reservoirs. The stimulation model with wave equations disclosed herein provides simulations, analyses and characterization of the vibrational displacements of solids and fluids respectively. The wave expressions propagating from the cylindrical sources are constructed in polar coordinate system with the utilization of Hankel function. This makes the availability of the evaluation of the dynamic response of the porous medium subjected to the excitations of multi-energy sources. Solutions of the model are developed with the employment of a moving-coordinate method. By making use of the model disclosed herein, the behavior of any specified point in the considered domain of the porous medium can be quantified, and the relative displacement between the fluid and solid of the medium can be conveniently determined. The wave field of the considered porous medium is thus determined for any given time and the analysis of the wave motions in the medium is then readily available. Various mechanical and physical parameters of the porous medium are taken into consideration in developing the governing equations of waves, thus the model established can be applied to different porous media as desired. The numerical simulations of this invention show the efficiency of applying the model established in quantifying the effects of the waves generated by different energy sources on the motions of the fluid and solid of a porous medium. The numerical computations demonstrate that the frequencies and amplitudes of the superposed waves can be controlled and modulated as desired by changing the frequencies, amplitudes and locations of the multiple energy sources. Those skilled in these arts will understand that although only one point is considered in the numerical calculations disclosed herein, the wave motions of all the particles in a selected domain can be conveniently determined and plotted by the formulas, and methods for their use as disclosed herein.

Those skilled in these arts will understand that the invention disclosed herein provides an understanding of how to apply mechanisms of seismic vibration for Enhanced Oil Recovery (EOR) from subterranean reservoirs by the use of vibrating seismic waves to increase the mobility of fluid materials in porous media such as subterranean geological formations encompassing subterranean voids. Hydrocarbon-containing substances, e.g., crude oil, contained within and about subterranean reservoirs comprising rock strata, are commonly intermixed with natural and/or introduced sources water. Significant quantities of naturally occurring crude oil are typically adhered to the rock strata by cohesive and adhesive bonding between the solid strata and the crude oil fluids. Seismic excitation generally increases the pore pressures within the rock strata thereby stimulating and promoting the mobility of molecules comprising fluid materials, e.g., hydrocarbon-containing substances contained within and about subterranean geological formations. Residual fluid hydrocarbon-containing substances in subterranean reservoirs, naturally occurring or introduced sources of water and geological strata have different physical densities and consequently, when vibrational seismic energy is delivered to a subterranean target comprising hydrocarbon-containing substances, water and rock strata, each of these components will respond in different ranges, intensities and duration of physical movements which can be defined by terms relative motion and relative displacements. The hydrocarbon-containing substances, as exemplified by crude oil, tend to vibrate differently from the rock strata in response to seismic excitation, i.e., the crude oil is mobilized by seismic excitation. The rapid vibration of crude oil in response to excitation by seismic vibrational energy enables the controllable movement of the mobilized oil in an energy-directed wave pattern. Continued seismic excitation over an extended time period results in reduction of the capillary forces adhering the crude oil to the rock strata pores thereby enabling the mobilized crude oil to cluster into a continuous fluidized stream. Furthermore, the contact angle between the rock formations and the fluids can be changed due to the wave motions being propagated in the porous media such that the hydraulic coefficient of friction is changed. All of these factors can increase the mobility of crude oil within subterranean reservoirs thereby enabling increases in the recovery of crude oil from subterranean reservoirs. However, it should be understood that a key aspect of the present invention is that the seismic wave motions must be "properly" applied on subterranean reservoirs. The "proper" vibration or desired motion at the selected point in the porous media considered requires appropriate amplitude, frequency, duration and direction of motion, under the excitation of artificial seismic waves.

The numerical modeling approach and related formulae and algorithms disclosed herein can be incorporated into computer software configured to communicate and cooperate with seismic apparatus, electronic seismic control devices and geophysico-chemical sensing apparatus to determine and generate such "proper" vibrational seismic energies directed at subterranean targets for selected durations of time, to controllably modulate the frequencies and amplitudes of the seismic energies, and to controllably redirect the seismic energies to different subterranean targets. The numerical modeling approach, formulae and algorithms of the present invention are manipulable to provide the "proper" seismic vibrations with a variety of different types of seismic apparatus, and with a plurality of said seismic apparatus, with a variety of electronic seismic control devices. Furthermore, the numerical modeling approach, formulae and algorithms of the present invention are manipulable with software programs configured for these purposes to provide means by which the individual wave frequencies and amplitudes of a plurality of vibrational seismic energies generated and emitted by a plurality of seismic apparatus, can be individually modulated to provide optimal mobilization and flow of crude oil within subterranean environments. Furthermore, it is within the scope of this invention to manipulate the numerical modeling approach, formulae and algorithms disclosed herein to superpose and correlatively generate vibrational seismic energies from a plurality of seismic apparatus directed at common subterranean targets.

Figure 16:
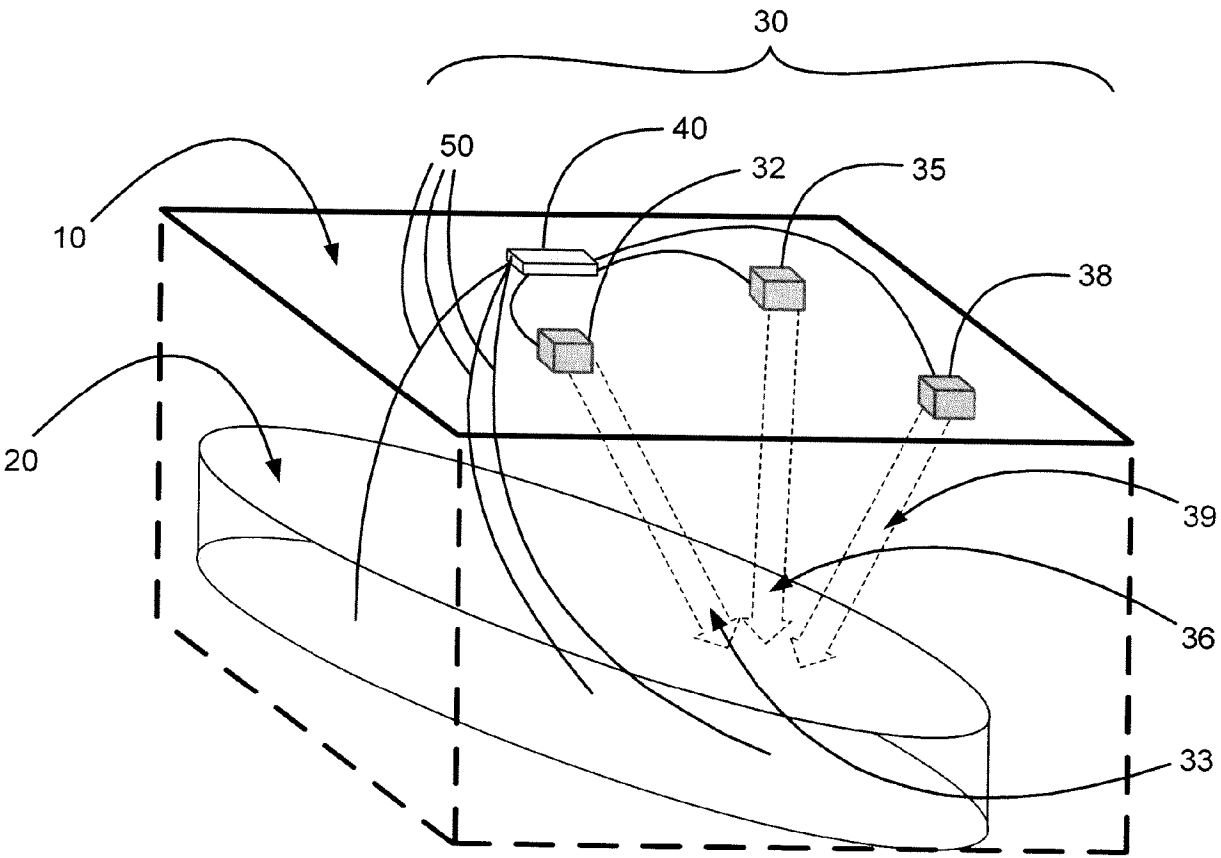
FIG. 16 is a schematic illustration of an exemplary system according an embodiment of the present invention.

The methods, apparatus, systems, numerical modeling approach and related formulae and algorithms disclosed herein enable energy-efficient generation of "proper" seismic vibrational waves. Prior art uses of vibrational energies for enhanced oil recovery are based on the waves generated by a single energy source or vertically aligned multiple energy sources. The energy thus produced is attenuated as the waves propagate away from the energy source. The methods and systems of the present invention disclosed herein, however, enable the generation of combinations of multiple waves propagating from multiple seismic energy sources toward a common target zone. An exemplary system 30 is shown in FIG. 16 positioned at ground level 10 above a subterranean reservoir 20. The system 30 comprises three seismic apparatus 32, 35, 38 which are positioned triangulated above the subterranean reservoir 20. The three seismic apparatus communicate with an electronic seismic control device 40. The electronic seismic control device 40 with a sensing apparatus 50 that is configured to detect, analyze, characterize and report fluidity and patterns of flow of hydrocarbon-containing materials within the subterranean reservoir 20. The electronic seismic control device 40 is configured to concurrently and controllably modulate the emission of vibrational energies 33, 36 39 from seismic apparatus 32, 35, 38, respectively. Furthermore, it is possible with the scope of the present invention to create and effect desired vibration amplitudes by synchronously and/or asynchronously combining energies accumulated by pluralities of overlapping, communicating and cooperating seismic waves that are continuously being emitted toward a common target from the multiple seismic energy sources. In other words, vibrational resonances can be controllably generated by overlapping, intersecting and combining the seismic vibrational energies emitted from the multiple sources. Since seismic waves are elastic waves, the vibrational resonances created by combining multiple seismic waves can be significantly large relative to the seismic energy emitted from a single source. Furthermore, it is within the scope of this invention to controllably manipulate the intersecting and/or overlapping and/or combining of multiple seismic vibrational energies to controllably create, modulate and manipulate cooperating reciprocating and/or vortexing and/or rolling motions of the targeted subterranean hydrocarbon-containing substances such as crude oil. Accordingly, the present invention is suitable for use during harvesting and recovery of crude oil from: (a) newly developed subterranean reservoirs, i.e. with new installations of wellbores into newly accessed subterranean reservoirs (for example, by reducing the numbers of wellbores required for conventional recovery of crude oil from such reservoirs), (b) low-producing subterranean reservoirs affected by the density of the crude oil contained therein, (c) depleted or "shut-in" wells wherein residual crude oil that was not accessible with conventional oil recovery methods and apparatus, remains in subterranean pools or crevasses, and (d) depleted reservoirs that were water-flooded during initial crude oil recovery containing therein crude oil droplet form suspended in pumped water remaining in such reservoirs.

While this invention has been described with respect to the preferred embodiments, it is to be understood that various alterations and modifications can be made to methods, apparatus and systems for manipulating the viscosities and flows of hydrocarbon-containing substances within subterranean reservoirs within the scope of this invention whereby which are limited only by the scope of the appended claims.

I claim:

1. A method for controllably mobilizing, flowing and maneuvering the flow of hydrocarbon-containing materials within and about a subterranean reservoir, said method comprising:

spacing apart and selectively positioning in a triangulated configuration above a subterranean reservoir containing therein a volume of hydrocarbon-containing materials, at least three seismic apparatus wherein each seismic apparatus is configured individually to controllably and directionally emit vibrational energies toward said hydrocarbon-containing materials, said vibrational energies comprising pluralities of seismic waves having electronically manipulable frequencies and amplitudes;

controllably manipulating an electronic seismic control device configured to communicate with and cooperate with each of said at least three seismic apparatus to concurrently modulate the amplitudes and frequencies of the vibrational energies produced thereby each of said seismic apparatus;

detecting with a sensing apparatus provided therefore, fluidity and patterns of flow and changes in the fluidity and the patterns of flow of the hydrocarbon containing materials within the subterranean reservoir, said sensing apparatus configured to communicate with and cooperate with said electronic seismic control device; and further controllably manipulating said electronic control device to modulate the frequencies and amplitudes of the seismic vibrational energies emitted by each of said at least three seismic apparatus to controllably maneuver the flow of said hydrocarbon-containing materials about said subterranean reservoir.

2. The method according to claim 1, wherein said at least three seismic apparatus are selectively positioned in a spaced-apart triangulated configuration at a ground surface level above the subterranean reservoir.

3. The method of claim 1, wherein two of said seismic apparatus are selectively positioned in at the ground surface level above the subterranean reservoir and the third seismic apparatus is selectively positioned in a borehole extending into the subterranean reservoir.

4. The method of claim 1, wherein two of said seismic apparatus are selectively positioned in separate boreholes extending into the subterranean reservoir and the third seismic apparatus is selectively positioned at the ground surface above the subterranean reservoir.

5. The method of claim 1, wherein two of said seismic apparatus are manipulated to emit vibrational energies having high frequencies and small amplitudes, and the third said seismic apparatus is manipulated to emit vibrational energies having lower frequencies and larger amplitudes.

6. The method of claim 5, wherein vibrational energies emitted by at least one of said seismic apparatus are intermittently pulsed.

7. The method of claim 1, wherein the seismic apparatus are pivoted and/or rotated to redirect their emission of vibrational energies.

* * * * *